US005514934A

United States Patent [19]

Matsumoto et al.

[11] Patent Number: 5,514,934

[45] Date of Patent: May 7, 1996

[54] DISCHARGE LAMP, IMAGE DISPLAY DEVICE USING THE SAME AND DISCHARGE LAMP PRODUCING METHOD

[75] Inventors: Sadayuki Matsumoto; Takeo Saikatsu; Osamu Myodo; Takehiko Sakurai; Hrumi Sawada; Junichiro Hoshizaki, all of Kamakura; Kazuo Yoshika, Nagasaki; Toshio Yamada; Hisae Nishimatsu, both of Tokyo, all of Japan

[73] Assignee: Mitsubishi Denki Kabushiki Kaisha, Tokyo, Japan

[21] Appl. No.: 339,505

[22] Filed: Nov. 14, 1994

Related U.S. Application Data

[63] Continuation of Ser. No. 891,273, May 29, 1992, abandoned.

[30] Foreign Application Priority Data

May 31, 1991 [JP] Japan ..... 3-129307
Feb. 10, 1992 [JP] Japan ..... 4-023653

[51] Int. Cl.[6] ..... H01J 61/00

[52] U.S. Cl. ..... 313/607; 313/1; 313/634; 313/493; 313/234

[58] Field of Search ..... 313/1, 607, 634, 313/635, 643, 356, 491, 493, 495, 514, 582, 234; 315/169.3; 345/37, 45, 47, 60, 76

[56] References Cited

U.S. PATENT DOCUMENTS

| | | | |
|---|---|---|---|
| 3,559,190 | 1/1971 | Bitzer et al. | 313/484 X |
| 3,886,393 | 5/1975 | Hinson | 313/485 X |
| 3,904,915 | 9/1975 | Hinson | 313/485 X |
| 4,013,912 | 3/1977 | Hinson | 313/642 |
| 4,549,109 | 10/1985 | Nighan et al. | 313/485 |
| 4,825,125 | 4/1989 | Lagushenko et al. | 313/611 X |
| 4,914,347 | 4/1990 | Osawa et al. | 313/485 |
| 5,013,966 | 5/1991 | Saikatsu et al. | 313/493 |
| 5,034,661 | 7/1991 | Sakurai et al. | 313/572 X |
| 5,049,777 | 9/1991 | Mechtersheimer | 313/607 X |
| 5,070,273 | 12/1991 | Yanden Bogert et al. | 313/607 |
| 5,117,160 | 5/1992 | Konda et al. | 313/607 X |

FOREIGN PATENT DOCUMENTS

| | | |
|---|---|---|
| 0348979 | 1/1900 | European Pat. Off. . |
| 0184216 | 6/1986 | European Pat. Off. . |
| 0329226 | 8/1989 | European Pat. Off. . |
| 0389980 | 10/1990 | European Pat. Off. . |
| 54-22867 | 8/1969 | Japan . |
| 56-5014 | 2/1981 | Japan . |
| 60-12660 | 7/1983 | Japan . |
| 61-127562 | 1/1985 | Japan . |
| 61-185857 | 8/1986 | Japan . |
| 63-64260 | 3/1988 | Japan . |
| 63-98163 | 4/1988 | Japan . |
| 2-129847 | 11/1988 | Japan . |
| 64-43947 | 2/1989 | Japan . |
| 3-225745 | 3/1990 | Japan . |
| 2-301960 | 12/1990 | Japan . |

OTHER PUBLICATIONS

"Optics Communications", Nov. 1980, vol. 35, Nos. 2 pp. 242–244.

J. Chem. Phys. vol. 74, No. 1, 1 Jan. 1981, pp. 483–493.

Proceedings of the SID, vol. 27/3, 1986 pp. 189–194.

IEEE Transactions on Electron Devices, vol. ED–30, No. 5, May 1983, pp. 439–443.

"Characteristics of Rare Gas Filled Fluorescent Lamp with Outside Electrodes", Proceedings of 1991 Annual Conference of the Illuminating Engineering Institute of Japan, Seiichiro Fujioka, Satoshi Tamura and Tsutomo Konda, Apr. 1991.

*Primary Examiner*—Sandra L. O'Shea
*Assistant Examiner*—Ashok Patel
*Attorney, Agent, or Firm*—Wolf, Greenfield & Sacks

[57] ABSTRACT

A discharge lamp having a large light output and a stable discharge. On an external surface of a cylindrical glass bulb enclosing a rare gas such as xenon, a pair of beltlike electrodes are mounted so as to face each other. A light output part is provided between the electrodes, and the electrodes are situated close to each other on the opposite side to the light output part. An image display device is constituted by arranging a plurality of the discharge lamps.

33 Claims, 23 Drawing Sheets

DISCHARGE LAMP, IMAGE DISPLAY DEVICE USING THE SAME AND DISCHARGE LAMP PRODUCING METHOD

This application is a continuation of application Ser. No. 07/891,273 filed on May 29, 1992 now abandoned.

BACKGROUND OF THE INVENTION i) Field of the Invention

The present invention relates to a discharge lamp to be used for a copy lighting device for information apparatuses such as a facsimile, a copier, an image reader and the like, a lightning bulletin board, a large display device, and the like, a display device using the discharge lamp, and a method for producing the discharge lamp.

ii) Description of the Related Arts

Conventionally, a fluorescent lamp is used as a light source for a copy lighting device of information apparatuses such as a facsimile, a copier, an image reader and the like. For such uses, a small type, a high luminance, a long life and high reliability are required for the lamp. Since the conventional fluorescent lamp is provided with electrodes such as filament electrodes within the tube, the structural limitation imposed by the electrodes is large, and a variety of attempts have been tried for settling problems.

In FIGS. 30*a* and 30*b*, for example, there is shown a conventional fluorescent lamp disclosed in proceedings of 1991 annual conference of the Illumination Engineering Institute of Japan. As shown in FIGS. 30*a* and 30*b*, the fluorescent lamp 1 comprises a cylindrical glass bulb 2 enclosing rare gases mainly composed of xenon gas therein, a fluorescent substance layer 3 formed on the internal surface of the glass bulb 2, a light output part 4 for emitting the generated light in the glass bulb 2 to the outside, a pair of external electrodes 5*a* and 5*b* mounted on the external surface of the glass bulb 2 and extending in the longitudinal direction thereof, and a power source 7 for supplying power between the external electrodes 5*a* and 5*b* through lead wires 6*a* and 6*b*.

When a voltage is applied between the external electrodes 5*a* and 5*b* from the power source 7, a current flows between them due to the electrostatic capacity therebetween and brings about a discharge between them both. By this discharge, UV (ultraviolet) rays are generated within the glass bulb 2, and the generated UV rays excite the fluorescent substance layer 3 formed on the internal surface of the glass bulb 2 to irradiate visible light outside through the light output part 4.

In the conventional fluorescent lamp, the aforementioned various defects due to the presence of the electrodes such as the filament electrodes within the glass bulb 2 can be improved upon. However, the following problems are still present. That is, as shown in FIGS. 30*a* and 30*b*, the distance between the electrodes on the opposite side to the light output part 4 is almost the same as the width of the light output part 4, and thus the sufficient electrode area can not be taken. Hence, a sufficient light output can not be obtained. Also, as the charged pressure of the rare gases within the glass bulb 2 is increased, the discharge between the electrodes 5*a* and 5*b* becomes unstable, and thus a fringe flicker is caused between the electrodes 5*a* and 5*b*. Further, since the distance between the electrodes 5*a* and 5*b* is wide, the size of the fringe caused between the electrodes 5*a* and 5*b* is wide. That is, due to this fringe, the luminance distribution in the longitudinal direction of the fluorescent lamp is uneven. The uneven luminance distribution brings about a problem in a case where the fluorescent lamp is used for the copy lighting of information apparatuses, where a plurality of fluorescent lamps are arranged to constitute an image display device, or the like.

SUMMARY OF THE INVENTION

It is therefore an object of the present invention to provide a discharge lamp in view of the aforementioned problems of the prior art, which is capable of obtaining a large light output and a stable discharge.

It is another object of the present invention to provide a discharge lamp capable of selectively generating a discharge in a plurality of parts.

It is a further object of the present invention to provide an image display device using a plurality of discharge lamps arranged, each discharge lamp being capable of obtaining a large light output and a stable discharge and selectively generating a discharge in a plurality of parts.

It is still another object of the present invention to provide a method for producing a discharge lamp capable of obtaining a large light output and a stable discharge and selectively generating a discharge in a plurality of parts. In accordance with one aspect of the present invention, there is provided a discharge lamp, comprising a container for enclosing a medium for discharge therein: and at least one surface electrode pair to which is applied a predetermined voltage to excite discharge space within the container, the surface electrode pair having two ends, a relative distance between one pair of ends facing each other being shorter than a relative distance between the other pair of ends facing each other.

In accordance with another aspect of the present invention, there is provided a discharge lamp, comprising a container for enclosing a medium for discharge therein; and at least one surface electrode pair to which is applied a predetermined voltage to excite discharge space within the container, at least one pair of ends of the surface electrode pair being separated by a distance ensuring electric insulation between them.

In accordance with a further aspect of the present invention, there is provided a discharge lamp, comprising a cylindrical container for enclosing a medium for discharge therein; and at least one surface electrode pair to which is applied a predetermined voltage, mounted so as to wind around a periphery of the cylindrical container, the surface electrode pair being arranged to be adjacent to each other in a direction of an axis of the cylindrical container.

The container can have a box form, and at least one electrode pair can be mounted on one surface of the box container.

The cylindrical container for enclosing a medium for discharge therein can be formed with a light output part provided at one end part of the cylindrical container, and a plurality of surface electrode pairs to be applied by a predetermined voltage can be mounted on surfaces of the cylindrical container except the light output part.

A plurality of surface electrode pairs can be mounted on surfaces of the container, and the predetermined voltage can be selectively applied to the surface electrode pairs.

A cross section of the cylindrical container enclosing a medium for discharge therein is an approximate triangle or an ellipse.

In a cylindrical container for enclosing a medium for discharge therein, a plurality of surface electrode pairs are provided on a peripheral surface of the container, and a voltage is selectively applied to the electrode pairs, the container including hollow parts between the electrode pairs.

By arranging a plurality of discharge lamps including a plurality of electrode pairs which control a voltage to be selectively applied to the electrode pairs, an image display device is constituted.

Further, the electrode pairs are divided into three kinds of red, green and blue color light generation to constitute a color image display device.

In accordance with still another aspect of the present invention, there is provided a method for producing the discharge lamp including hollow parts between the electrode pairs, comprising the steps of heating predetermined parts of the container, and reducing the pressure within the container so that it becomes narrower at the heated parts.

In accordance with still another aspect of the present invention, there is provided a method for producing the discharge lamp including narrow sections between the electrode pairs, comprising the steps of sealing the container at a predetermined pressure lower than an atmospheric pressure, and in heating the predetermined parts so that the container becomes narrower at the heated parts.

In the aforementioned discharge lamp, the electrode area can be widened and thus a large light output can be obtained.

By providing the ends of the surface electrodes in close proximity to each other, the discharge generated between the electrodes can be stabilized.

Further, a plurality of surface electrode pairs are formed, and a high frequency voltage is selectively applied to the electrode pairs to generate the discharge and cause the light generation at only the voltage applied electrode parts.

BRIEF DESCRIPTION OF THE DRAWINGS

These and other objects, features and advantages of the present invention will more fully appear from the following description of the preferred embodiments with reference to the accompanying drawings, in which.

DESCRIPTION OF THE PREFERRED EMBODIMENTS

Figure 1A:
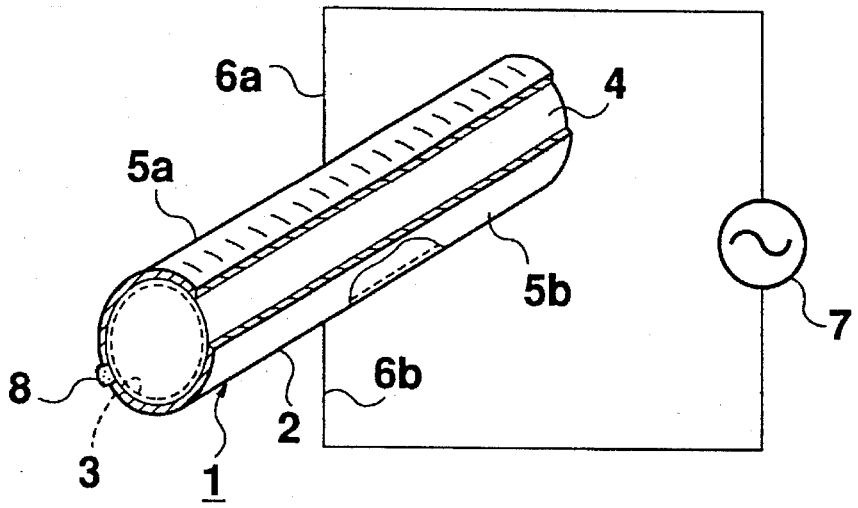
FIGS. 1*a* and 1*b* are schematic perspective and cross sectional views of a first embodiment of a discharge lamp according to the present invention.
Figure 1B:
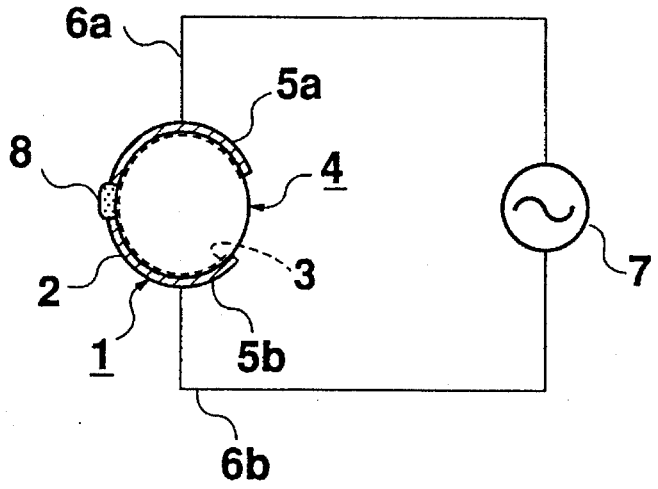

Referring now to the drawings, wherein like reference characters designate like or corresponding parts throughout the views and thus the repeated description thereof can be omitted for brevity, there is shown in FIG. 1 the first embodiment of a discharge lamp according to the present invention.

As shown in FIG. 1, in a fluorescent lamp 1, a glass bulb 2 has a straight cylinder form having dimensions of, for example, a diameter of 10 mm and a length of 220 mm, and a fluorescent substance layer 3 is formed on almost the entire internal surface of the glass bulb 2. A rare gas such as xenon at a pressure such as 70 Torr is enclosed in the glass bulb 2. A part having a width such as approximately 4 mm along the entire length of the glass bulb 2, on which the fluorescent substance layer 3 is not formed, constitutes a light output part 4 for emitting the light generated within the glass bulb 2 to the outside. A pair of external electrodes 5*a* and 5*b* having a width such as approximately 12 mm are mounted on the external peripheral surface of the glass bulb 2 along the entire length thereof except at the light output part 4 spaced apart by, for example, approximately 2 mm less than the width of the light output part 4 on the opposite side to the light output part 4. An insulating member 8 for preventing a dielectric breakdown between the electrodes 5*a* and 5*b* on the external peripheral surface of the lamp is formed on the external surface of the glass in the space between the external electrodes 5*a* and 5*b*. A power source 7 for supplying electric power is connected to the external electrodes 5*a* and 5*b* through lead wires 6*a* and 6*b*.

Next, the operation of the fluorescent lamp having the above-described structure will be described. That is, when a voltage is applied between the external electrodes 5*a* and 5*b* from the power source 7, the voltage is supplied to the xenon gas within the glass bulb 2 through the glass of the dielectric substance to cause the discharge between the electrodes 5*a* and 5*b*. At this time, the UV rays generated within the glass bulb 2 excite the fluorescent substance layer 3 and are converted into visible light at the fluorescent substance layer 3, and the generated visible light from the fluorescent substance layer 3 is irradiated to the outside through the light output part 4.

The principle of the aforementioned light emission will now be described in detail. That is, in the fluorescent lamp 1, since the discharge is taking place between the electrodes 5*a* and 5*b* through the glass of the dielectric substance, the current flowing through the glass bulb 2 is limited and the discharge is not developed from the glow discharge to the arc discharge. Further, the discharge is not concentrated at a particular place, and the discharge is caused from the entire internal surface of the glass bulb 2 facing the external electrodes 5*a* and 5*b*. If the thickness and the like of the glass are constant and the dielectric property in substance is uniform, the current density of the internal surface of the glass bulb 2 facing the electrodes 5*a* and 5*b* becomes uniform and thus the density of the generated UV rays becomes almost uniform. Hence, the generation of the visible light is also almost uniform. As a result, the luminance distribution of the lamp surface becomes almost uniform. Further, current flows only directly after the polarity of the applied voltage is inverted, and the electric charge is accumulated on the internal surface of the glass bulb 2 except that current which flow to stop the current. As a result, pulsed current flows in the lamp.

In addition, when the discharge state within the lamp is carefully observed, the entire internal surface of the glass bulb 2 directed towards the external electrodes 5*a* and 5*b* is covered by the almost uniform light, and further many fine filiform discharges between the opposite electrodes 5*a* and 5*b* are generated at almost the same interval in a fringy form. When the rare gas is enclosed within the glass bulb 2, by this discharge, first, the rare gas atom collides with an electron to be excited to a resonance level. Since the pressure of the rare gas is high in the glass bulb 2, the excited atom having this resonance level collides with another rare gas atom having a ground level to form an excimer of a diatomic molecule. This excimer irradiates the UV rays to return to two rare gas atoms having the ground level. Since the UV rays generated by the excimer do not cause a self absorption like the resonant UV rays of the atom, almost all of the UV rays reach the internal surface of the glass bulb 2 and are converted into the visible light by the fluorescent substance layer 3 formed on the internal surface of the glass bulb 2. Namely, in the light generation by the excimer, the brighter light can be obtained. Further, when xenon is used as the rare gas, in comparison with a glow discharge lamp having electrodes therein with much resonant UV rays of xenon of 147 nm, there are mainly UV rays irradiated by the excimer of approximately 170 nm in the present fluorescent lamp. The long wavelength of the UV rays is advantageous with regard to light generation efficiency and deterioration of the fluorescent substance.

In this embodiment, since the fluorescent lamp 1 has a length of 220 mm and the electrodes 5*a* and 5*b* are mounted on the external surface of the glass bulb 2 along the entire length thereof, the discharge condition is almost constant along the entire length of the glass bulb 2, and the entire length of the fluorescent lamp 1 becomes the effective light generation part. For example, when the fluorescent lamp 1 is used for reading a copy of A4 size, it is sufficient to use a lamp having almost the same length as the width of the copy, and thus a further miniaturization of information apparatuses is possible.

Further, since there are no electrodes within the fluorescent lamp 1, a limited life due to consumption of the internal electrodes does not result, and there is no occurrence of total unusability due to a sudden breakdown of the lamp, which has been a serious problem in the information apparatuses.

For example, by using a glass bulb of soda glass having a thickness of 0.6 mm and $M_2SiO_5$: Tb (M=Y, Sc) as the fluorescent substance, when a voltage of 800 V at a frequency of 50 kHz is applied between the external electrodes 5*a* and 5*b*, a luminance of approximately 30000 cd/m$^2$ on the light output part 4 is obtained. This voltage condition is the same easily managable level as used in a usual cold cathode fluorescent lamp using mercury (Hg). Further, its luminance is extremely high compared with that of a cold cathode lamp using a glow discharge of xenon. Furthermore, since the glass bulb of the lamp of this embodiment has a cylindrical form which is strong for use with a vacuum, the thickness of the glass of the bulb 2 can be reduced, and thus the impedance of the glass as the dielectric substance can be reduced. As a result, the lamp can be discharged at a low frequency and a low voltage.

Figure 2:
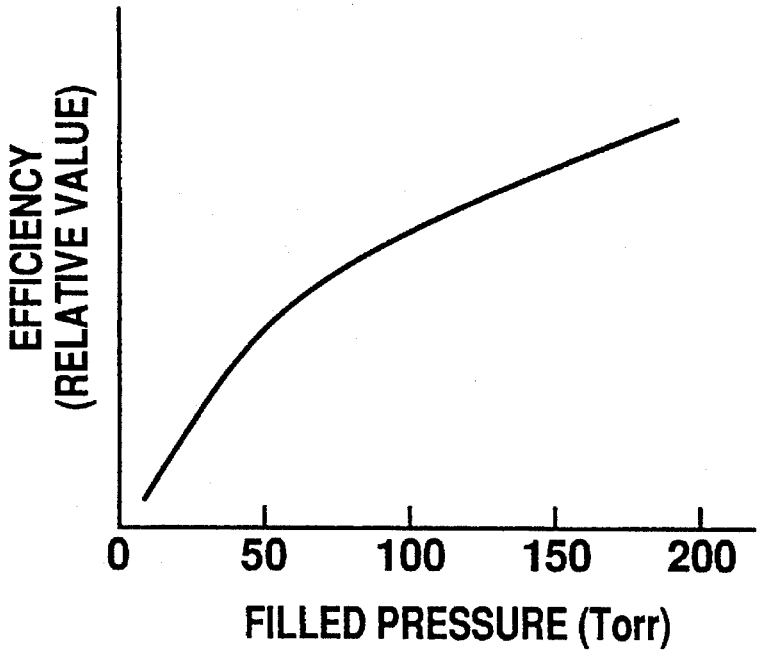
FIG. 2 is a graphical representation showing the relationship between the filled pressure of rare gases in a cylindrical glass bulb and lamp efficiency of the discharge lamp according to the present invention.

In FIG. 2, there is shown the relationship between an enclosed rare gas pressure within a cylindrical glass bulb 2 and lamp efficiency of the fluorescent lamp 1 according to the present invention. The lamp efficiency can be obtained from a value calculated by dividing the luminance by the electric power. It is readily understood from FIG. 2 that, as the enclosed gas pressure is decreased, the efficiency is suddenly reduced. This is considered that, since the light generation is due to the UV rays generated by the excimer and the generation of the excimer is due to the collision between the rare gas atoms, a low enclosed rare gas pressure brings about a low probability of the excimer formation. The fine filiform discharge can be observed at a pressure of more than 30 Torr. At a lower pressure than 30 Torr, the discharge is extended like a glow discharge, and the radiation of near IR (infrared) rays of the atomic spectrum of the rare gas becomes strong. From the viewpoint of the effective generation of the excimer and the use of its light generation, the enclosed gas pressure is preferably more than 30 Torr. As seen, gas pressure of greater than 100 Torr is efficient.

Figure 3:
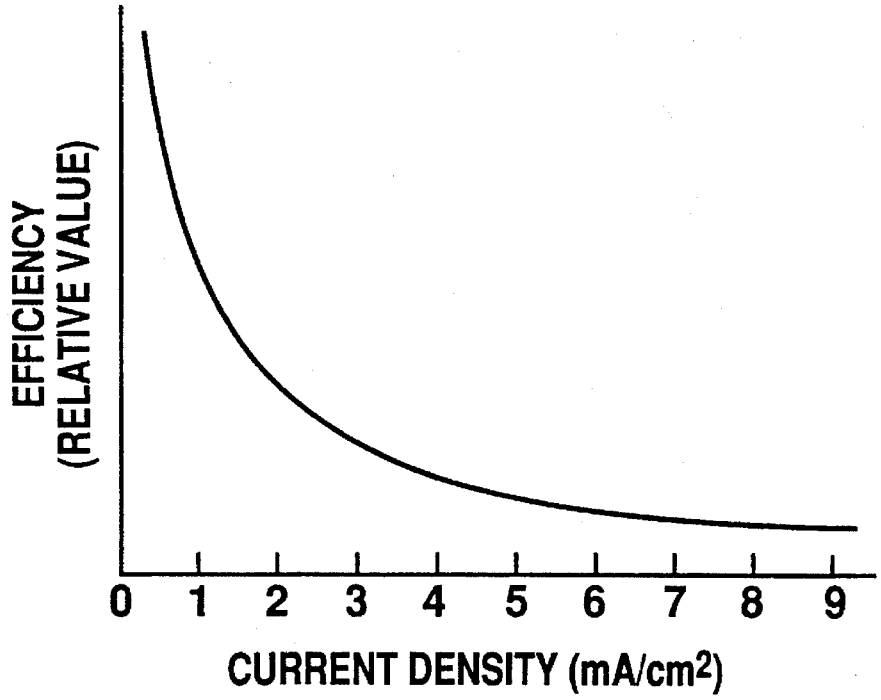
FIG. 3 is a graphical representation showing the relationship between the current density flowing between external electrodes and lamp efficiency of the discharge lamp according to the present invention.

In FIG. 3, there is shown the relationship between density of a current flowing between the external electrodes 5*a* and 5*b* and the lamp efficiency of the fluorescent lamp 1 according to the present invention. As seen in FIG. 3, current density of less that 5ma/cm$^2$ is efficient. In the fluorescent lamp of this embodiment, since the discharge is generated at only the portions facing the external electrodes 5*a* and 5*b*, the characteristics of the lamp can be largely affected by the current density rather than the whole amount of current flowing in the lamp. That is, since the electrode area is large, the large electric power can be committed to the medium for the discharge even at the low current density and hence the efficiency is high. Further, when the current density is low, the intensity of the near IR in infrared rays irradiated by the xenon atom is weak. In the lamp including the electrodes therein, since the current density near the electrodes is high, the near IR rays as the atomic spectrum of the rare gas are strong, which is detrimental to the copy reading in the facsimile. Hence, it is necessary to use a filter for cutting the near IR rays. In the fluorescent lamp of this embodiment, no such filter is required and it is quite suitable for copy reading in the facsimile or the like.

Figure 4:
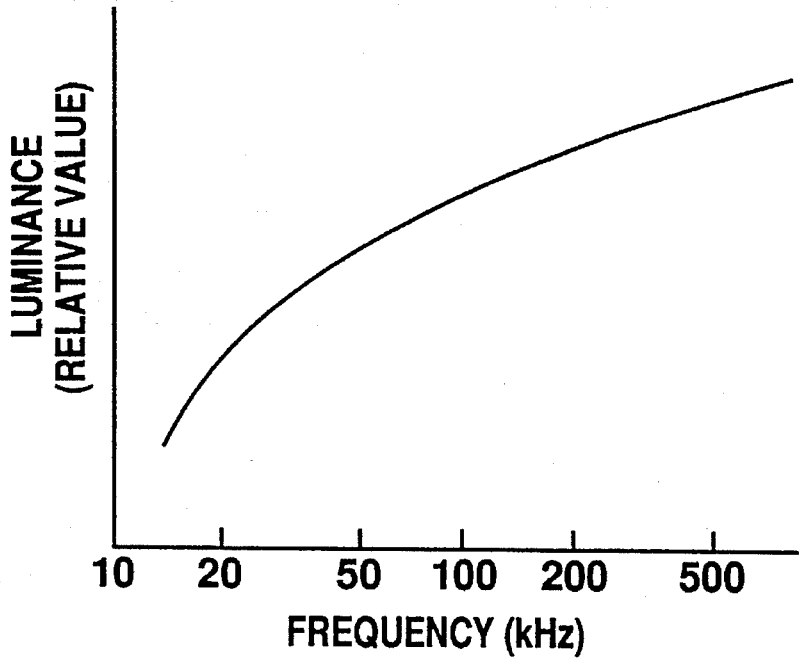
FIG. 4 is a graphical representation showing the relationship between the frequency of a voltage applied to the external electrodes and luminance of the discharge lamp according to, the present invention.

In FIG. 4, there is shown the relationship between the frequency of the voltage applied to the external electrodes 5*a* and 5*b* and the luminance of the fluorescent lamp 1 according to the present invention. It is readily understood from FIG. 4 that the higher the frequency, the higher the luminance obtained. The reason for this is as follows. That is, since the voltage is applied from the external surface of the glass, as the frequency is lowered, the impedance of the glass increases, and it is difficult to supply sufficient electric power to the rare gas. Further, when the frequency is low, the discharge is apt to be unstable, and uneven luminance is liable to be caused. Also, since the noise is inclined to be caused when a relatively high voltage is used, the harsh noise is apt to be generated in the audio frequency band. From the view points described above, in this embodiment, the lamp is preferably supplied with a voltage a frequency of more than 20 kHz. On the other hand, since, as the frequency is increased, the larger electric power can be supplied and the luminance becomes higher, the current density is increased and thus the efficiency drops. Further, by providing the electrodes outside of the bulb, it is hard to avoid the generation of a magnetic noise, and in order to avoid interference to a radio receiver or the like, the frequency of the voltage is preferably less than 500 kHz lower than the radio frequency.

Figure 5:
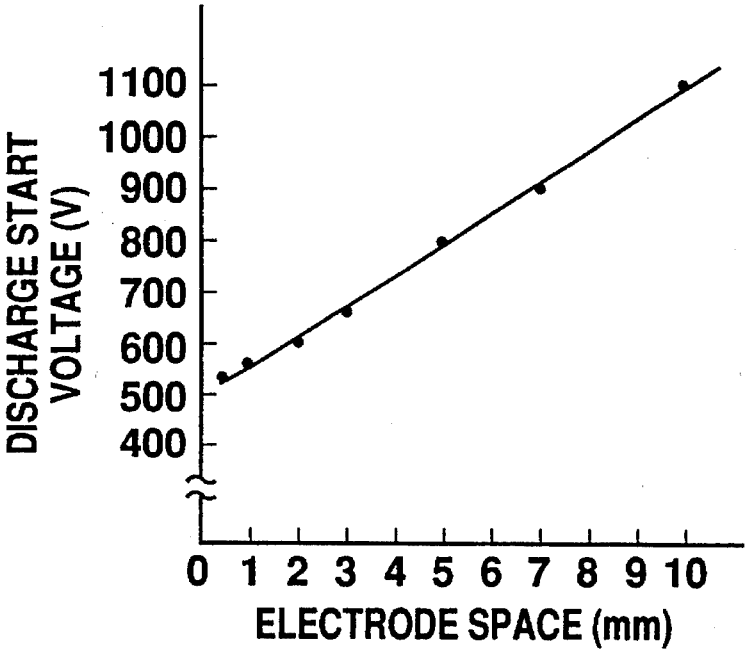
FIG. 5 is a graphical representation showing the relationship between the distance between the external electrodes and a discharge start voltage of the discharge lamp according to the present invention.

In FIG. 5, there is shown a discharge start voltage when an interval between the external electrodes 5*a* and 5*b* is varied at an enclosed gas pressure of 30 Torr in the fluorescent lamp 1 according to the present invention. It is apparent from FIG. 5 that the discharge start voltage is increased almost in proportion to the interval between the electrodes 5*a* and 5*b*. That is, it is considered that the discharge system of this fluorescent lamp meets Paschen's law as the enclosed gas pressure is increased, the discharge start voltage is raised. Hence, the interval between the electrodes is preferably as narrow as possible, but, in practice, it is preferably less than 3 mm. In the lamp of this embodiment, even when the interval between the electrodes is narrow, the efficiency is not reduced, and as a result, the discharge start voltage can be reduced, unlike a conventional fluorescent lamp using a light generation of a positive column generated at a separate position from the electrodes.

Further, since the UV rays are mainly generated on the internal surface of the lamp facing the electrodes, when the electrode area is large, the light output is large. In particular, when the opening angle of the light output part 4 is large and the external electrodes 5*a* and 5*b* are positioned on the opposite side to the light output part 4, it is very much effective to obtain the large light output.

Furthermore, since the discharge is stable, attributable to the narrow distance between the electrodes 5*a* and 5*b*, the uniform luminance distribution can be obtained in the axial or longitudinal direction of the cylindrical container such as the glass bulb 2. In addition, since, as the electrode interval is narrowed, the interval of the fringy discharge is narrowed, by observing the discharge state, it is found that the luminance distribution is further made uniform.

Figure 6A:
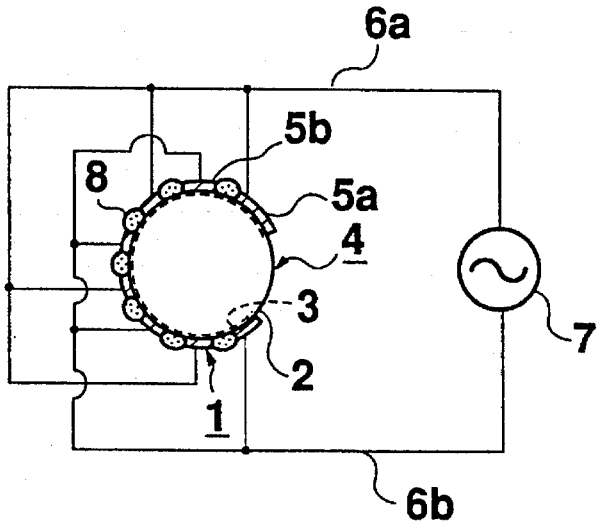
FIGS. 6*a* and 6*b* are cross sectional views of a second embodiment of a discharge lamp having a plurality of external electrode pairs arranged in the peripheral direction of a cylindrical glass bulb according to the present invention.
Figure 6B:
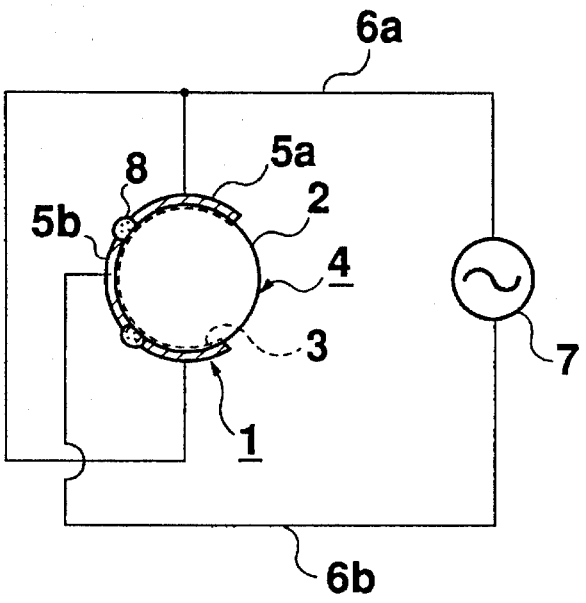

In FIGS. 6*a* and 6*b*, there is shown the second embodiment of the discharge lamp according to the present invention. Although there is provided one pair of external electrodes in the first embodiment shown in FIGS. 1*a* and 1*b*, in this embodiment, at least two pairs of external electrodes 5*a* and 5*b* are formed on the external surface of the glass bulb 2 in the peripheral direction thereof, as shown in FIG. 6*a*, or two electrodes 5a are formed on both sides of the electrode 5b in the peripheral direction of the glass bulb 2, as shown in FIG. 6b. In this case, the discharge is caused between each pair of electrodes and the operation is performed in the same manner with the same effects as described above in the first embodiment.

Figure 7:
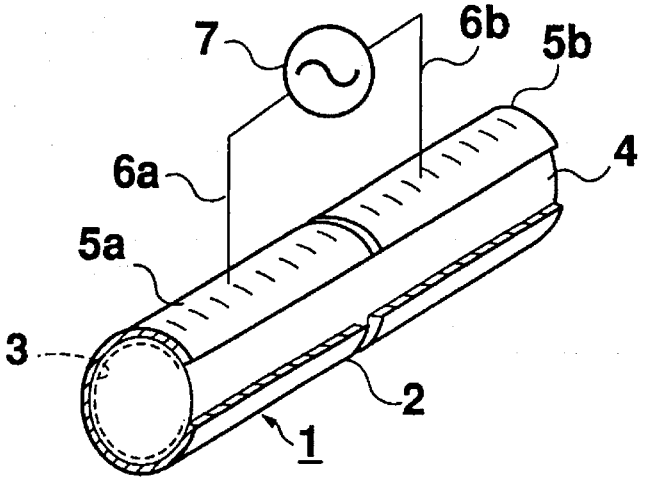
FIG. 7 is a schematic perspective view of a third embodiment of a discharge lamp having external electrodes arranged in the longitudinal direction of a cylindrical glass bulb according to the present invention.

In FIG. 7, there is shown the third embodiment of the discharge lamp according to the present invention. In this embodiment, surface electrodes 5a and 5b are formed on the external surface of the cylindrical glass bulb 2 so as to surround the peripheral surface of the adjacent two halves obtained by dividing the glass bulb 2 in the longitudinal direction. In this construction, the discharge is uniformly generated on the surface of the electrode parts, and the same effects as those of the preceding present embodiments can be obtained. In this instance, an insulating member (not shown) is preferably provided in a gap between the electrodes 5a and 5b in order to prevent the dielectric breakdown between the electrodes 5a and 5b on the external peripheral surface of the lamp.

In the first to third embodiments, as described above, although the external electrodes 5a and 5b are formed over the entire external surface of the glass bulb 2 except the light output part 4, when not so large a light output is required, the electrodes 5a and 5b can be formed on only part of the external surface of the glass bulb 2.

Figure 8:
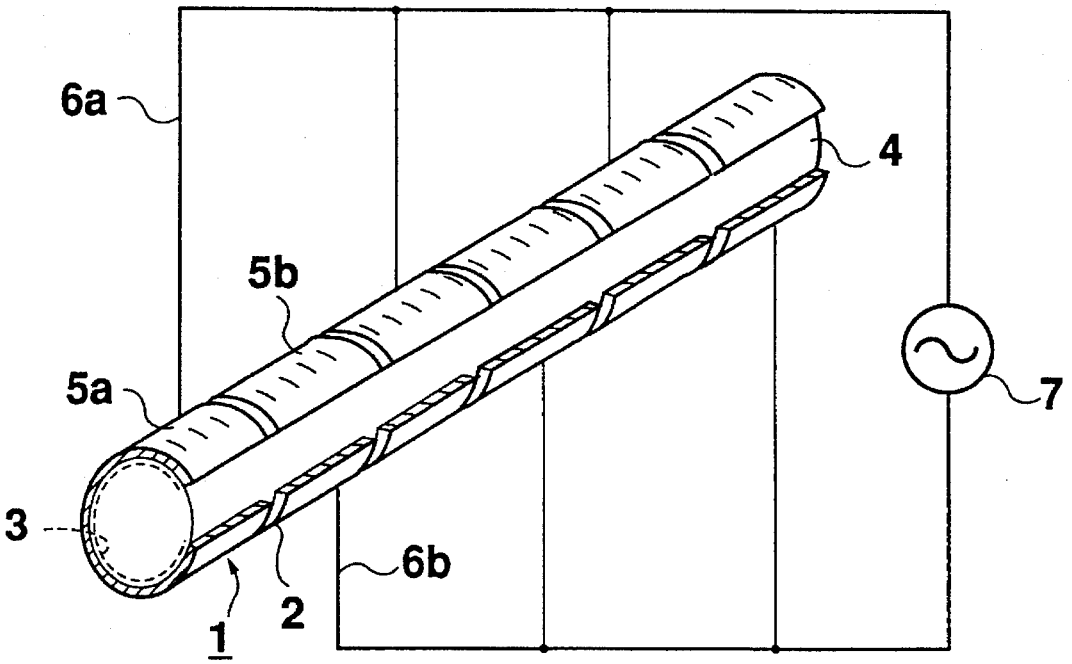
FIG. 8 is a schematic perspective view of a fourth embodiment of a discharge lamp having a plurality of external electrode pairs arranged in the longitudinal direction of a cylindrical glass bulb according to the present invention.

In FIG. 8, there is shown the fourth embodiment of the discharge lamp according to the present invention. In this embodiment, a plurality of electrode pairs are arranged on the external surface of the glass bulb 2 in the longitudinal direction thereof. In this case, even in a long lamp, the UV rays generation amount becomes uniform at any part in the longitudinal direction, and an improved luminance distribution over the entire length of the lamp can be obtained. In the fluorescent lamp 1 shown in FIGS. 1a and 1b or FIGS. 6a and 6b, of course, a plurality of electrode pairs can be arranged in the longitudinal direction of the glass bulb 2 in the same manner as described above.

Figure 9A:
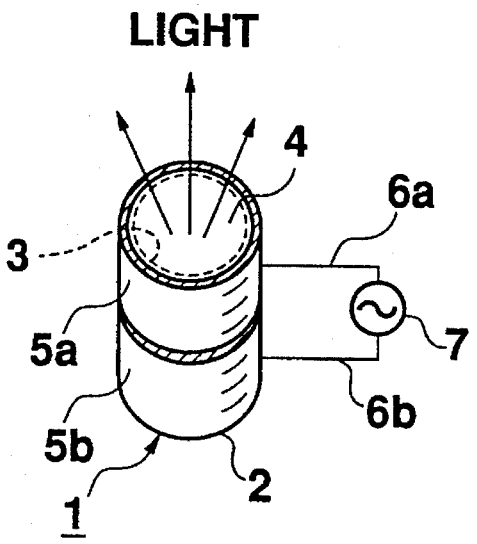
FIGS. 9*a* and 9*b* are schematic perspective views of a fifth embodiment of a discharge lamp having a light output part at one end of a cylindrical glass bulb according to the present invention.
Figure 9B:
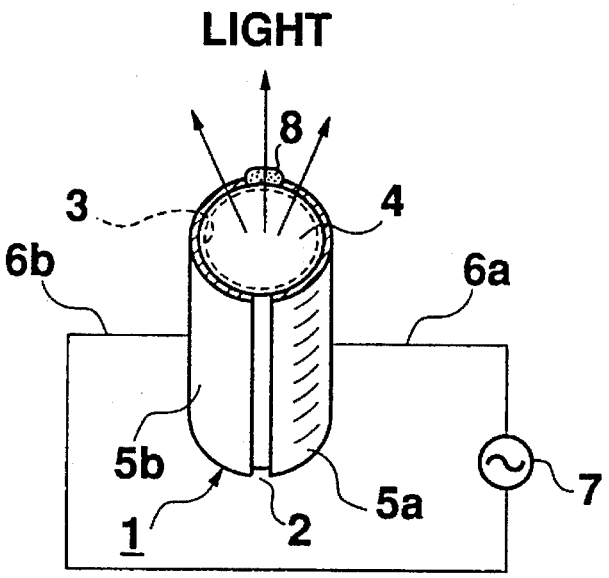

In FIGS. 9a and 9b, there is shown the fifth embodiment of the discharge lamp according to the present invention. In this embodiment, one end of the cylindrical glass bulb 2 is formed to be transparent and a light output part 4 is formed in this transparent end. A fluorescent substance layer 3 is formed on the internal surface of the cylindrical glass bulb 2 except at the light output part 4 of the transparent end, and a pair of external electrodes 5a and 5b are formed on substantially the entire external peripheral surface of the cylindrical glass bulb 2 in the same manner as the first and third embodiments shown in FIG. 1a and FIG. 7. This structure is suitable for applications requiring an extremely large light output. In order to obtain the large light output, it is necessary to supply a larger electric power, and in turn, as shown in FIG. 3, in order to obtain a high efficiency, it is required to restrict the current density to a low value. In order to supply the large electric power while the current density is kept at a the low value, it is sufficient to enlarge the electrode area.

In the fluorescent lamp of this embodiment, since the peripheral surface area can be enlarged even when the area of the end part as the light output part 4 of the cylindrical glass bulb 2 is small, the electrode area can be enlarged. That is, while the current density is maintained at a low valve, the large electric power can be supplied to obtain the fluorescent lamp having a high efficiency and a large light output. Further, since there is no light interception member such as electrodes within the glass bulb 2, the light is not lost. The fluorescent substance layer 3 is further formed on the end part opposite to the light output part end part of the glass bulb 2, and this fluorescent substance not only converts the UV rays into the visible light but also functions to reflect the light generated within the glass bulb 2. As a result, an extremely bright light can be output to the outside through the light output part 4. Hence, the fluorescent lamp can be properly used for pixels of a display device or the like required to display an image outdoors in the daytime.

Further, the electrodes can be formed on the end part opposite to the light output part in addition to the peripheral surface of the glass bulb 2, and in this case, the whole electrode area can be further enlarged. Thus, a further large electric power can be supplied. Further, the UV rays are generated on mainly the surfaces of the electrodes, and the bright lighting effect of the electrode surfaces is further added to obtain the fluorescent lamp having further high efficiency and brightness.

In this embodiment, the two opposite end parts of the glass bulb 2 can be either a flat surface or a curved surface. Further, the end part opposite to the light output part 4 is not restricted to the fluorescent substance layer and can be formed into a structure reflecting the light such as various reflecting films, a white color substance or the like.

Figure 10A:
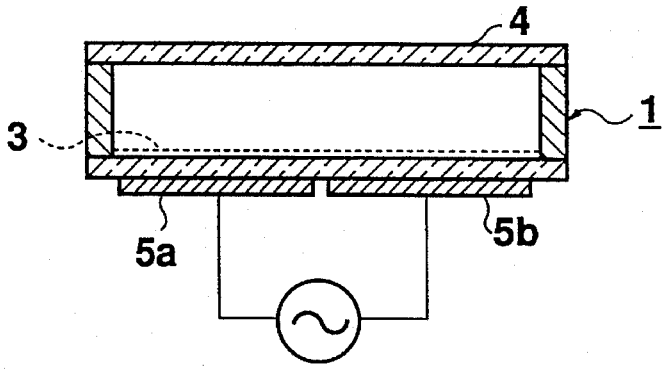
FIGS. 10*a* and 10*b* are cross sectional and elevational views of a sixth embodiment of a discharge lamp having a box form according to the present invention.
Figure 10B:
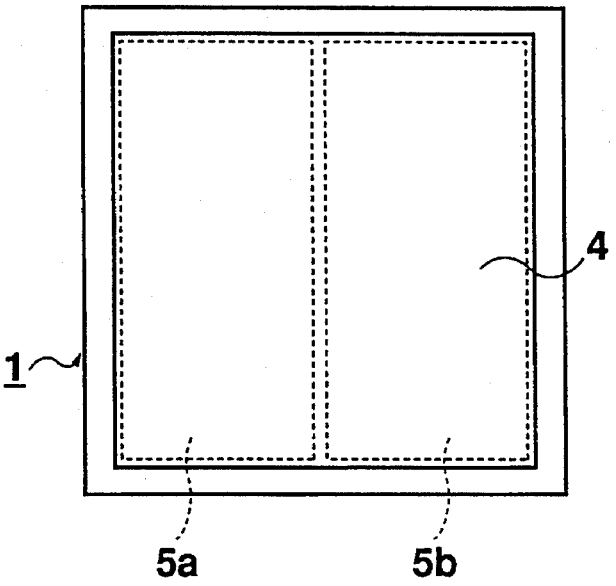

In FIGS. 10a and 10b, there is shown the sixth embodiment of the discharge lamp according to the present invention. In this embodiment, a box type container for enclosing the medium such as the rare gas for the discharge is used in place of the cylindrical glass bulb used in the first to fifth embodiments. Of course, the size and shape of the container for the discharge medium enclosure is not restricted and any shape such as a straight cylinder, a sphere, a triangular column, a box, or the like can be used. In this embodiment, a pair of flat electrodes 5a and 5b are mounted on the entire external surface of the bottom of the box container, and a fluorescent substance layer 3 is formed on the internal surface of the bottom. The top is a light output part 4 opposite to the electrodes 5a and 5b.

In this embodiment, an AC voltage is applied between the external electrodes 5a and 5b to cause the discharge therebetween, and the light generation is carried out in the same manner as described above to irradiate the light to the outside through the light output part 4. In this case, the excimer is generated on the surface part of the electrodes in the same manner as described above, and the uniform luminance distribution can be performed to obtain the fluorescent lamp having high efficiency without unevenness unlike a conventional fluorescent lamp using a light generation of a positive column generated at a separate position from the electrodes.

Figure 11:
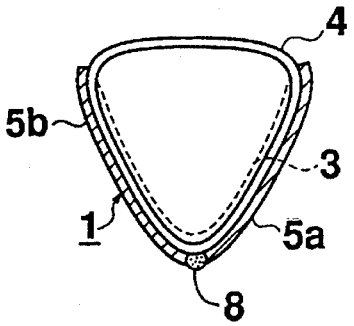
FIG. 11 is a cross sectional view of a seventh embodiment of a discharge lamp including a glass bulb having a triangular cross section according to the present invention.

In FIG. 11, there is shown the seventh embodiment of the discharge lamp according to the present invention. In this embodiment, a triangular column glass bulb is used. With regard to the triangular cross section of the glass bulb, the three vertex parts are rounded and the three sides can be composed of a curved line having a larger radius of curvature than a radius of curvature of the vertex parts. In this case, the external electrodes 5a and 5b are formed on two side surfaces of the glass bulb and the light output part 4 is formed on the other side surface. In this instance, the area of the external electrodes 5a and 5b compared with the projection area of the light output part 4 can be enlarged rather than the circular cross section of the cylindrical glass bulb, and a brighter fluorescent lamp can be constructed.

Figure 12:
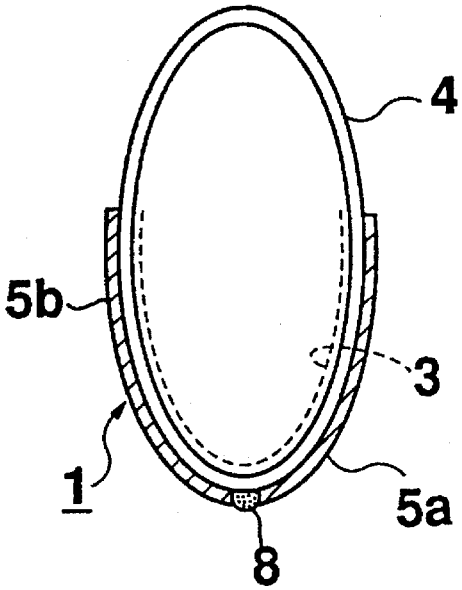
FIG. 12 is a cross sectional view of an eighth embodiment of a discharge lamp including a glass bulb having an elliptical cross section according to the present invention.

In FIG. 12, there is shown the eighth embodiment of the discharge lamp according to the present invention. In this embodiment, an elliptical column glass bulb having an elliptical cross section is used, and the same effects and advantages as those of the above-described embodiments can be obtained.

Figure 13:
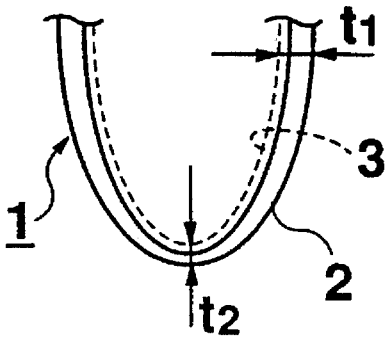
FIG. 13 is a fragmentary cross sectional view showing the thickness of the glass bulb having the elliptical cross section shown in FIG. 12.

In this case, when the thickness of the glass bulb 2 is formed to be uniform, the stress distribution of the glass bulb 2 becomes uneven. Hence, the thickness of the small stress portions can be made relatively thin, as shown in FIG. 13 wherein t2<t1. When the voltage is applied between the electrodes, an electrical field in the discharge space is caused between the electrode—the dielectric substance layer (glass)—the discharge space—the dielectric substance layer (glass)—and the electrode. Since the field intensity is in inverse proportion to the electrode distance, when the thinned portions of the glass are partially formed, the dielectric substance (glass) layer is thinned, and the field intensity of the thinned part is enlarged even when the applied voltage is constant. As a result, the discharge start voltage can be lowered. In this instance, as described above, when the discharge start voltage can be lowered, a high voltage circuit conventionally provided for applying a high voltage at the discharge start time can be omitted, and thus the present apparatus can be formed by using only a voltage circuit for supplying a voltage at a usual discharge time.

Figure 14A:
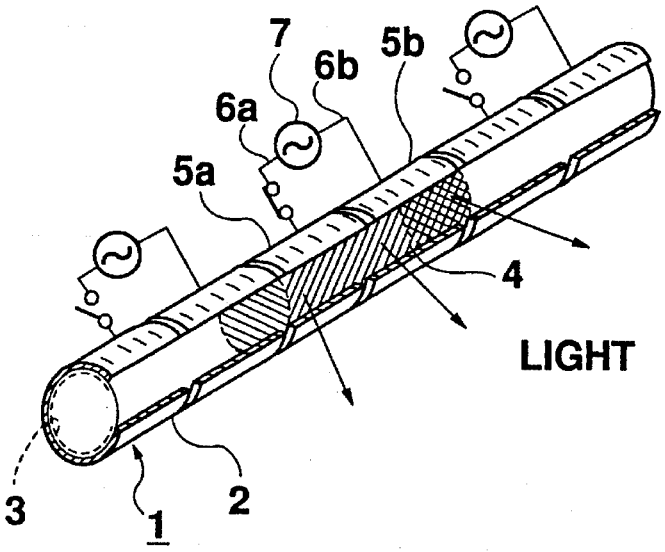
FIGS. 14*a* and 14*b* are perspective views of a ninth embodiment of a discharge lamp having a plurality of external electrode pairs, in which voltages or currents to be applied to the electrode pairs can be independently controlled, according to the present invention.
Figure 14B:
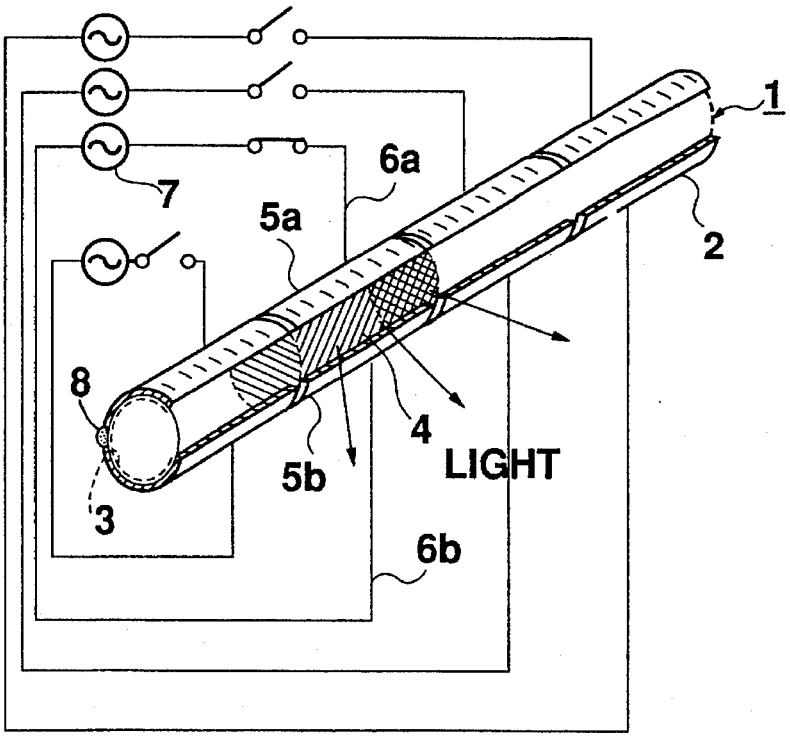

In FIGS. 14*a* and 14*b*, there is shown the ninth embodiment of the discharge lamp according to the present invention. In this embodiment, a plurality of external electrode pairs are arranged in the longitudinal direction of the cylindrical glass bulb 2, and an electric power source 7 for applying a voltage or current and a switching element connected in series with the electric power source 7 are provided for each electrode pair so as to independently control the voltages or currents applied to the electrode pairs. By carrying out an ON - OFF control of each switching element, only electrode parts with a voltage applied start to perform the discharge to emit the light. This utilizes the phenomenon that the discharge is generated at only the electrode parts with a voltage applied and is not extended outside therefrom.

Figure 15:
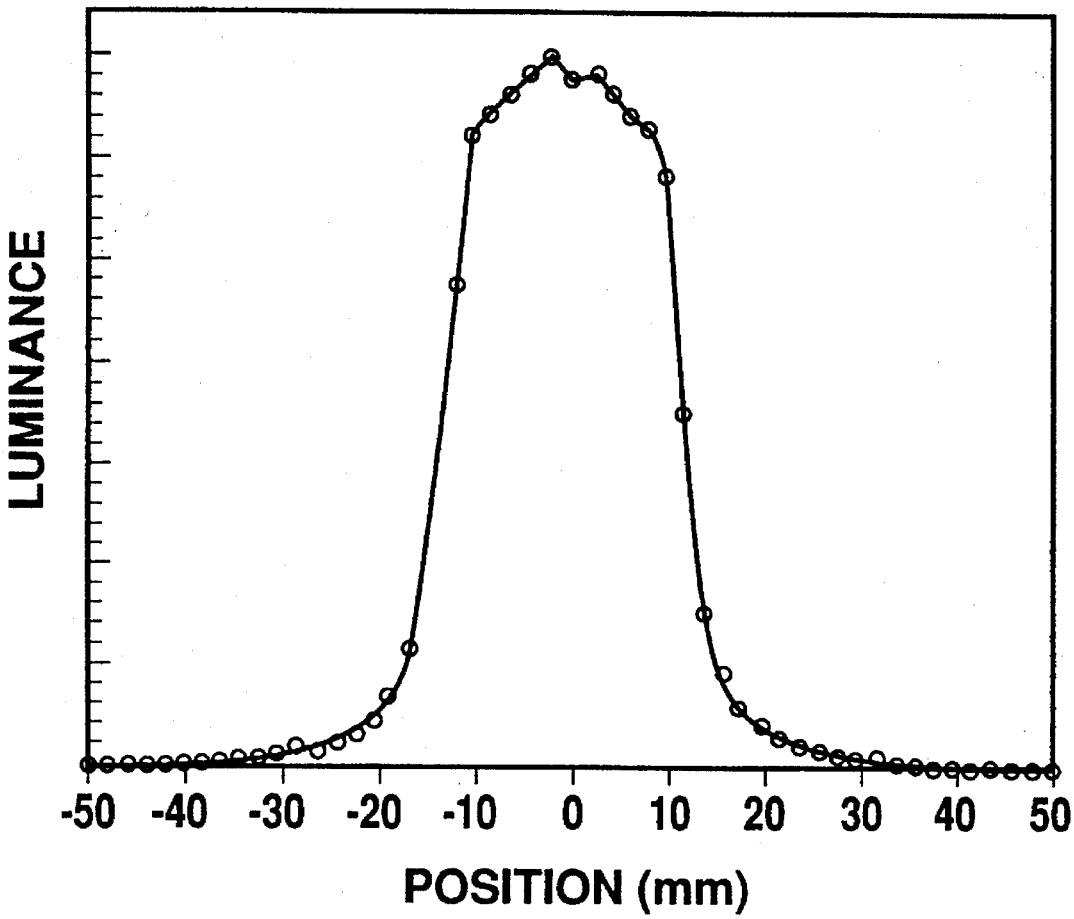
FIG. 15 is a graphical representation showing the relationship between the position from the center of the electrode pair and luminance of the discharge lamp shown in FIG. 14*a;*

For instance, in the fluorescent lamp 1 shown in FIG. 14*a*, with the cylindrical glass bulb 2 diameter of 10 mm and a light output part 4 opening angle of 180 0†, the fluorescent substance layer 3 is formed on the half of the peripheral surface of the glass bulb 2, and a plurality of electrode pairs, each being composed of two electrodes having a width of approximately 12 mm and arranged a distance of approximately 1 mm apart, are arranged at a pitch of 36 mm. Now, when the voltage is applied to only one electrode pair to cause it to discharge, the luminance distribution measured in the longitudinal direction of the lamp is as shown in FIG. 15 wherein the center of the electrode pair is determined to be at 0 mm on the positional scale.

In this case, when the discharge is generated between the electrode pair, the surfaces of the electrode parts are brightly illuminated, and at the 0 mm position having no electrode, the luminance is somewhat reduced. As described above, only the electrode parts with the voltage applied can be illuminated, and a considerably high luminance ratio of the illuminated part with reference to the adjacent unilluminated part can be obtained. That is, in the system of this embodiment, the light generation of parts of the glass bulb 2 can be controlled without providing a plurality of electrodes within the glass bulb 2. Accordingly, the fabrication of this lamp can be extremely easily carried out, and the influence of the unevenness of the electrode characteristics is small compared with a light generation control of the conventional lamp including a plurality of electrodes within the lamp. Hence, the reliability of the fluorescent lamp according to the present invention is extremely high.

Figure 16A:
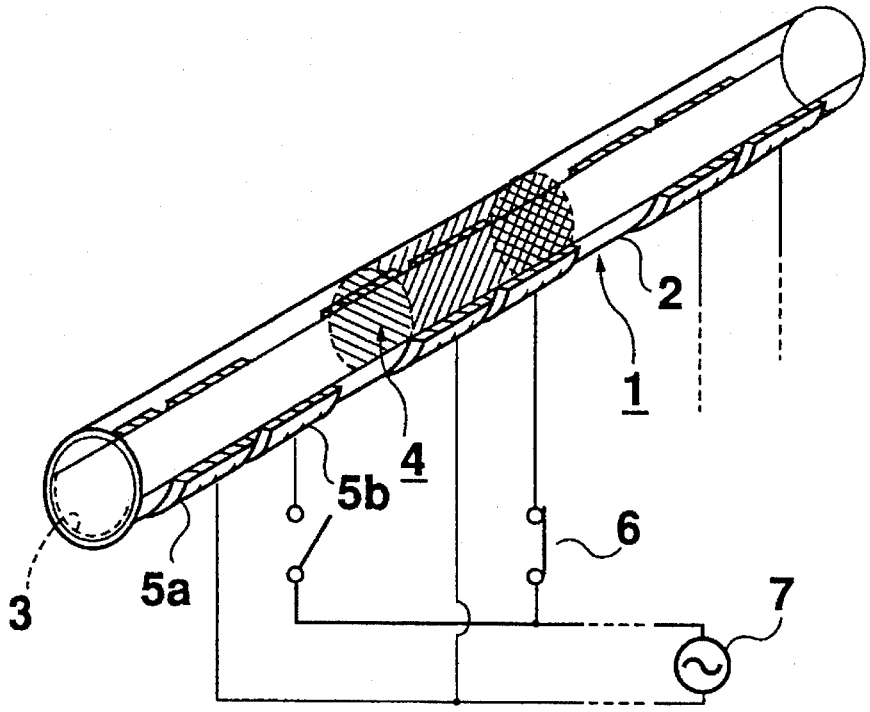
FIGS. 16*a* and 16*b* are schematic perspective and cross sectional views of a tenth embodiment of a discharge lamp having a plurality of external electrode pairs, in which voltages or currents to be applied to the electrode pairs can be independently controlled, according to the present invention.
Figure 16B:
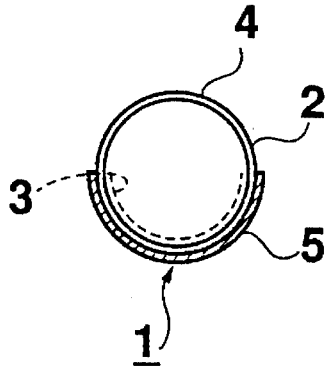

In FIGS. 16*a* and 16*b*, there is shown the tenth embodiment of the discharge lamp according to the present invention. In this embodiment, a plurality of external electrode pairs are formed on approximately half the external peripheral surface of the cylindrical glass bulb 2 and are arranged in the longitudinal direction of the glass bulb 2, and the fluorescent substance layer 3 is formed on approximately half the internal peripheral surface facing the electrodes. The plurality of electrode pairs are connected to one electric power source 7 through the respective switching elements. In the fluorescent lamp having the above-described construction, the projection area of the light output part 4 can be made maximum. This means that the rate of the lighting area against the image display area can be made large when this fluorescent lamp is applied to an image display device hereinafter described in detail, and a high quality display device can be obtained.

Figure 17:
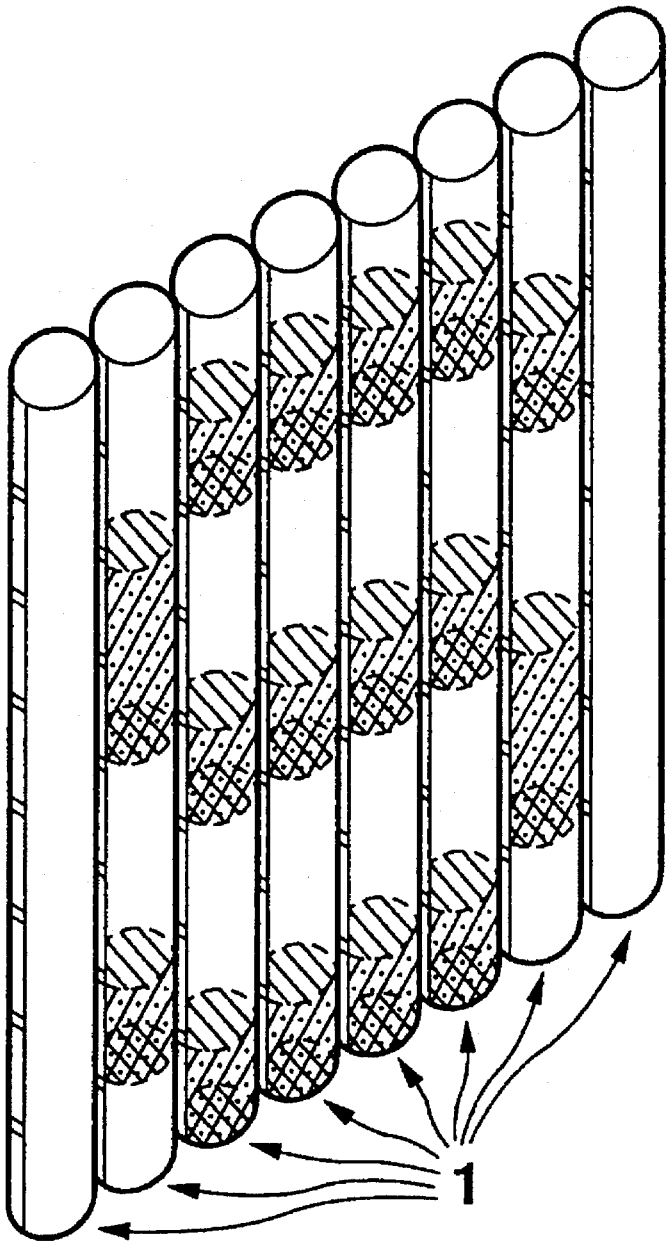
FIG. 17 is a schematic perspective view of a first embodiment of an image display device composed of a plurality of discharge lamps shown in FIGS. 14*a* and 14*b* or FIGS. 16*a* and 16*b;*

In FIG. 17, there is shown the first embodiment of an image display device produced by arranging a plurality of fluorescent lamps 1 shown in FIGS. 14*a* and 14*b* or FIGS. 16*a* and 16*b* according to the present invention. In this embodiment, one electrode pair is used as one pixel, and a voltage is selectively applied to a plurality of electrode pairs arranged to display a symbol, a character, a figure or the like.

Figure 18:
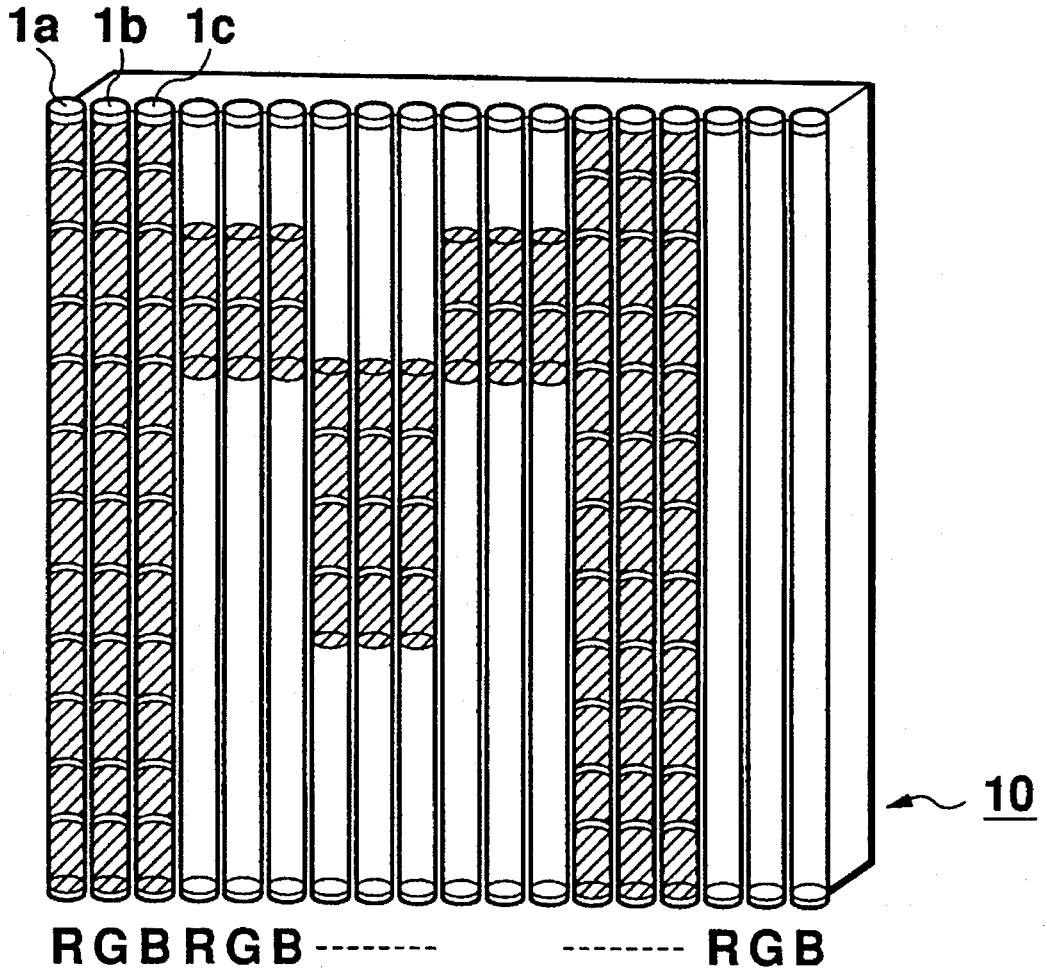
FIG. 18 is a schematic perspective view of a second embodiment of an image display device composed of a plurality of three primary colors R, G and B of discharge lamps shown in FIGS. 14*a* and 14*b* or FIGS. 16*a* and 16*b;*

In FIG. 18, there is shown the second embodiment of an image display device 10 produced by arranging a plurality of fluorescent lamps shown in FIGS. 14*a* and 14*b* or FIGS. 16*a* and 16*b* according to the present invention. In this embodiment, the fluorescent lamps are divided into fluorescent lamps 1*a*, 1*b* and 1*c* of three primary colors R, G and B to constitute a full color image display device 10. The fluorescent lamps 1*a*, 1*b* and 1*c* of three primary colors R, G and B can be obtained by changing the illumination color of the fluorescent substance formed on the internal surface of the glass bulb 2 of the fluorescent lamp. In this case, by using three such color fluorescent lamps, a inexpensive color image display device having an extremely high reliability can be easily produced.

Further, in this embodiment, the fluorescent lamp utilizing the UV rays irradiated by the excimer has high efficiency compared with a conventional fluorescent lamp using the UV rays irradiated by an atom. In a conventional fluorescent lamp using the discharge between internal electrodes for use in a display device, for example, as disclosed in Japanese Patent Laid-Open No.Hei 2-129847 and Japanese Utility Model Laid-Open No. Sho 61-127562, since the UV rays irradiated from the positive column generated between the electrodes is utilized, when the electrode distance is narrow, the efficiency is bad. However, in the present fluorescent lamp, since the narrower electrode distance brings about better efficiency, the pixel size can be reduced without reducing the efficiency.

Further, in the conventional fluorescent lamp, since a filament hot cathode is used, heat is largely generated by the preheating of the filament and thus the efficiency is low. In turn, in the image display device using the fluorescent lamp according to the present invention, since the efficiency is high and the heat generation is low, a large scale cooling device used in the conventional image display device is not required. Further, in the conventional fluorescent lamp, since mercury is used, there is temperature dependency, and in the conventional image display device, a temperature control device for maintaining the temperature of the lamp is required. In turn, in the present fluorescent lamp, since only the rare gas is used, there is no temperature dependency, and the temperature control device is not required.

Figure 19:
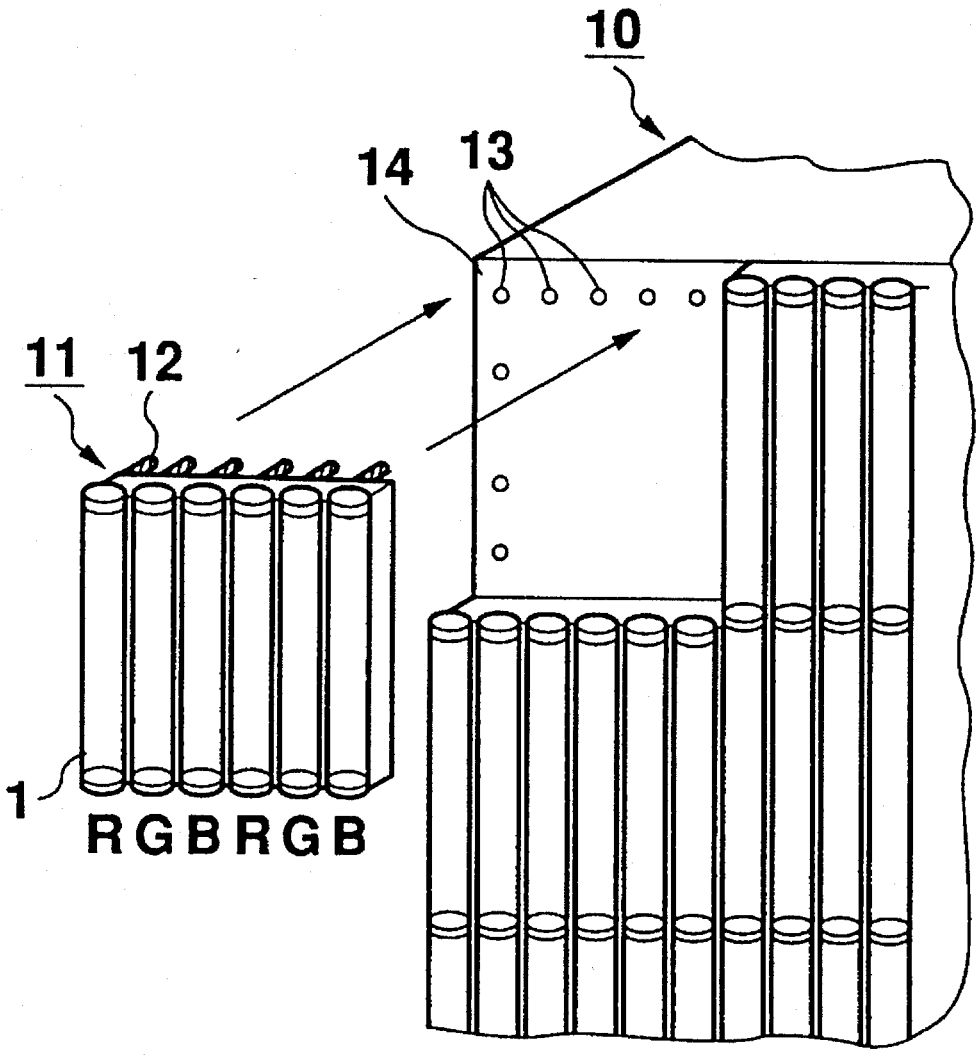
FIG. 19 is a fragmentary exploded perspective view of a third embodiment of an image display device composed of a plurality of display units each composed of a plurality of discharge lamps shown in FIGS. 14*a* and 14*b* or FIGS. 16*a* and 16*b;*

In FIG. 19, there is shown the third embodiment of an image display device 10 composed of a plurality of display units 11 each composed of a plurality of discharge lamps 1 shown in FIGS. 14*a* and 14*b* or FIGS. 16*a* and 16*b* according to the present invention. In this embodiment, each display unit 11 is formed with feeding pins 12 connected to external terminals 5 of the fluorescent lamps 1, and the feeding pins 12 of the display unit 11 are connected to feeding terminals 13 provided on a body 14 of the image display device 10 to thus mount the display unit 11 to the body 14. As described above, an image plane of the image display device 10 is divided into a plurality of subimage planes composed of the display units 11. This construction is very effective for producing a large scale display device having a large image plane. That is, in the large scale display device, if the system can not be unitized, it is necessary to fabricate fluorescent lamps having a long length depending on the size of the image plane. However, in this embodiment, by using the unitized fluorescent lamps, the display device,having a large image plane can be readily constructed by increasing the number of the display units 11. Hence, the assembling of the image display device can be readily carried out, and the breakage of the lamps can be effectively prevented.

Figure 20A:
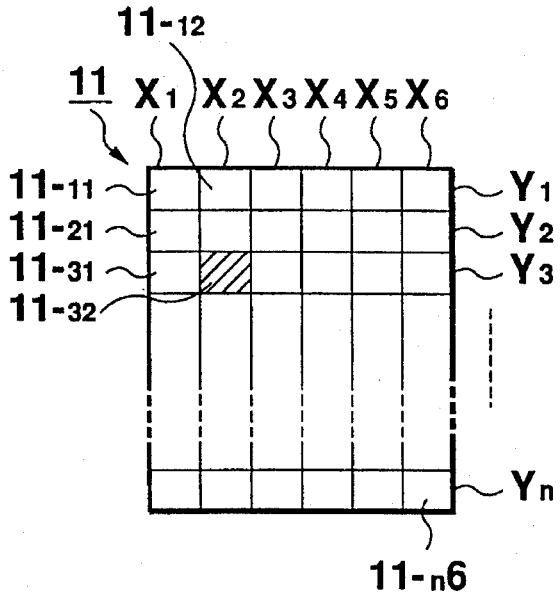
FIGS. 20*a* and 20*b* are schematic elevational and side views of a structure of the electrodes of the display unit shown in FIG. 19, and FIGS. 20*c* and 20*d* are cross sections, taken along the respective lines 20*c*—20*c* and 20*d*—20*d* in FIG. 20*b;*
Figure 20B:
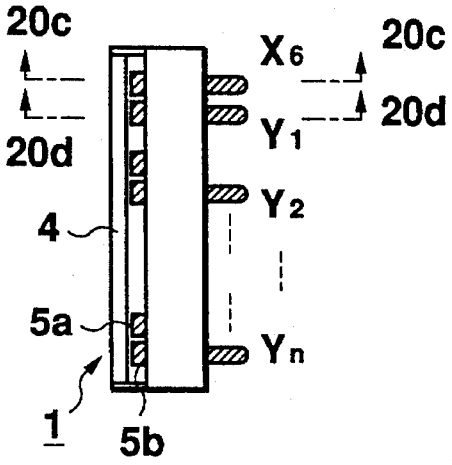
Figure 20C:
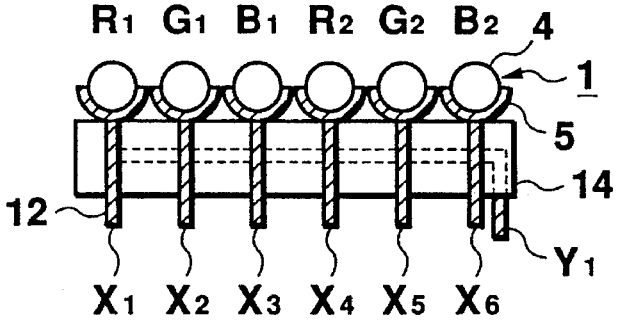
Figure 20D:
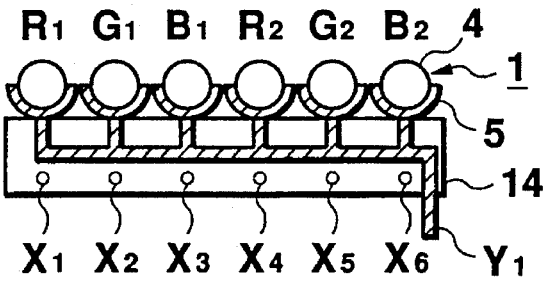

In FIGS. 20*a* to 20*d*, there is shown a construction of the electrodes of the display unit shown in FIG. 19. In this instance, as shown in FIG. 20*a*, the structure has a similar structure to the matrix wiring used for a liquid crystal image display device. The display unit 11 is comprised of a matrix of 6×n pixels 11-11, 11-21, . . . , 11-n6, and as shown in FIGS. 20*b* to 20*d*, for the matrix of the columns and the rows of the pixels, one set of external electrodes 5*a* corresponding to the columns are connected to feeding pins X1 to X6 and the other set of external electrodes 5*b* corresponding to the rows are connected to Y feeding pins Y1 to Yn. In this matrix type display unit 11, in order to illuminate the pixel 11-32, the switching elements (not shown) connected to the feeding pins X2 and Y3 are turned on to apply the voltage to the electrode pair corresponding to the pixel 11-32. In the structure of the display unit 11 as described above, the number of the feeding pins compared with the number of the pixels can be largely reduced.

In this embodiment, although 2 sets of the fluorescent lamps of the three primary colors R, G and B, that is, 6 fluorescent lamps altogether are unitized for each row of the display unit 11, the number of the fluorescent lamps is not restricted to this number, and any number of the fluorescent lamps can be used so long as they are in groups of three for the three primary colors R, G and B in one unit.

In the aforementioned image display devices using the cylindrical discharge lamps according to the present invention, as shown in FIG. 15, there occurs a little light generation between the adjacent electrode pairs, and due to this light generation, the contrast of the image is sometimes deteriorated. In order to improve this problem, a mask for covering the space between the electrode pairs can be provided. A holding member for holding the fluorescent lamps 1 can be used as a mask as well. Some embodiments of this case are shown in FIGS. 21, 22, 23*a* and 23*b*.

Figure 21:
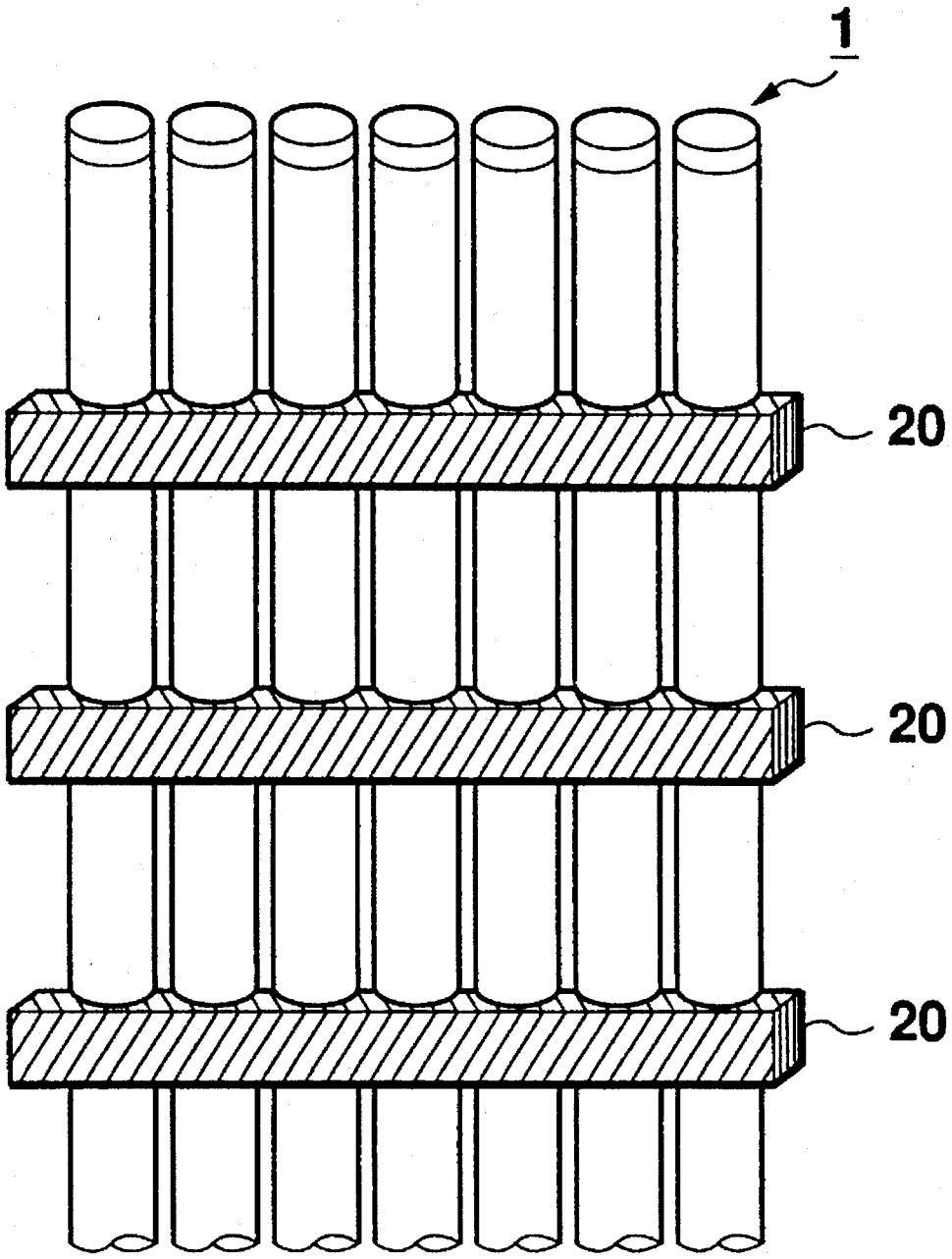
FIG. 21 is a perspective view of a fourth embodiment of an image display device composed of a plurality of discharge lamps held by holding members having a masking function according to the present invention.

In FIG. 21, there is shown the fourth embodiment of an image display device composed of a plurality of fluorescent lamps held by holding members 20 having a masking function according to the present invention. In this embodiment, the holding members 20 also mask the space between the electrode pairs.

Figure 22:
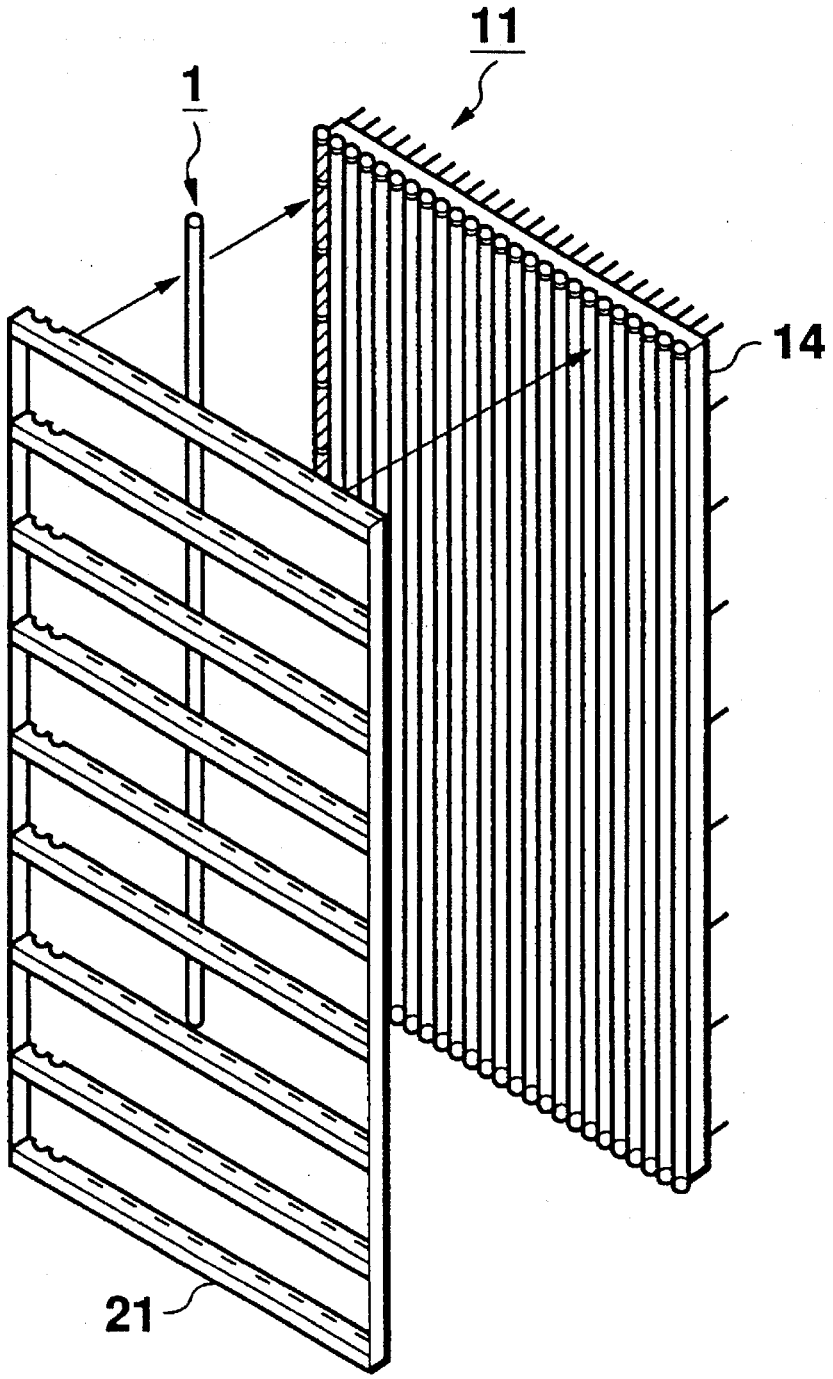
FIG. 22 is a perspective view of a display unit composed of a plurality of fluorescent lamps held by a holding panel including a plurality of holding members having a masking function according to the present invention.

In FIG. 22, there is shown a display unit 11 composed of a plurality of fluorescent lamps 1 held by a holding panel 21 including a plurality of holding members 20 having a masking function according to the present invention. In this embodiment, a plurality of holding members 20 are constructed to the holding panel 21 every display unit 11.

Figure 23A:
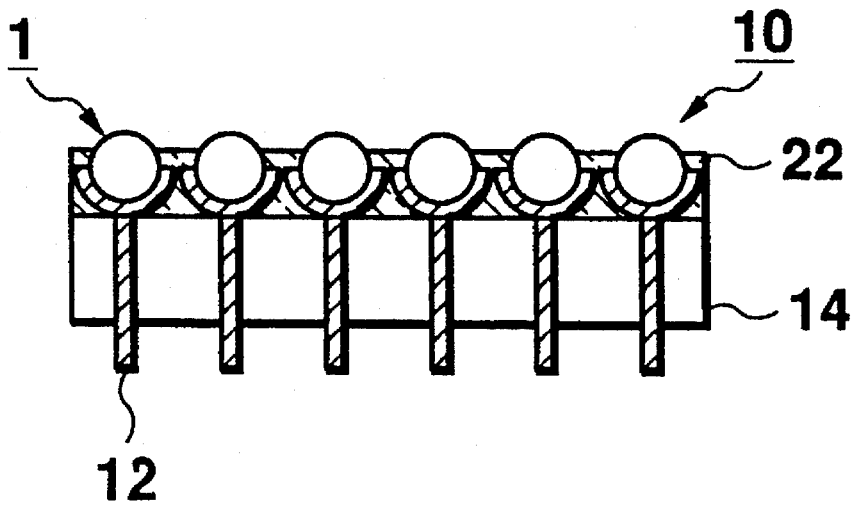
FIGS. 23*a* and 23*b* are cross sections of another display unit composed of a plurality of discharge lamps held by holding members according to the present invention.
Figure 23B:
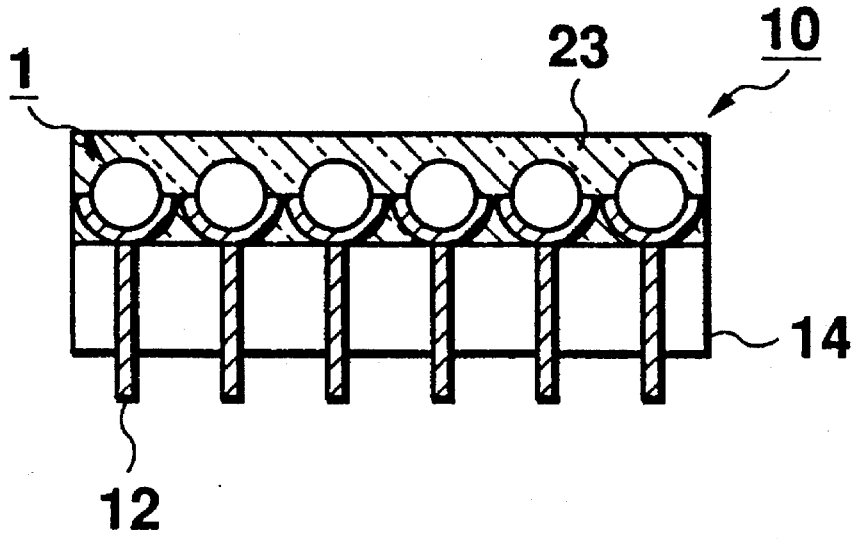

In FIGS. 23*a* and 23*b*, there is shown another display unit composed of a plurality of fluorescent lamps 1 held by holding members 22 and 23 according to the present invention. As shown in FIG. 23*a*, the fluorescent lamps 1 are held to the display unit 11 by the holding member 22 of an epoxy resin or the like. As shown in FIG. 23*b*, the fluorescent lamps 1 are held to the display unit 11 by the holding member 23 of a transparent resin material or the like so that the transparent resin holding member 23 may completely cover the fluorescent lamps 1. In this embodiment, the holding of the fluorescent lamps 1 to the display unit 11 can be exactly performed, and further the dielectric breakdown between the electrodes can be prevented by the resin material. Further, the fluorescent lamps 1 are entirely covered by the transparent resin material to improve the waterproof property, as shown in FIG. 23*b*.

Figure 24A:
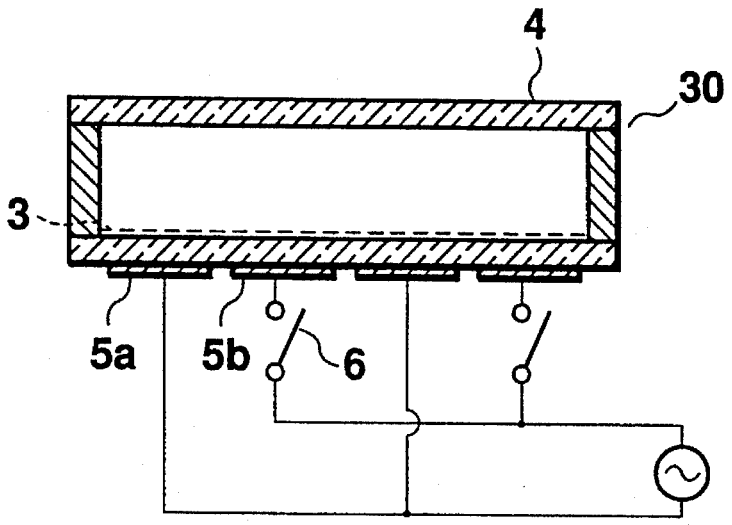
FIGS. 24*a* and 24*b* are cross sectional and elevational views of an eleventh embodiment of a box type discharge lamp to be used as one pixel for a color image display device, including three primary color (R, G and B) parts according to the present invention.
Figure 24B:
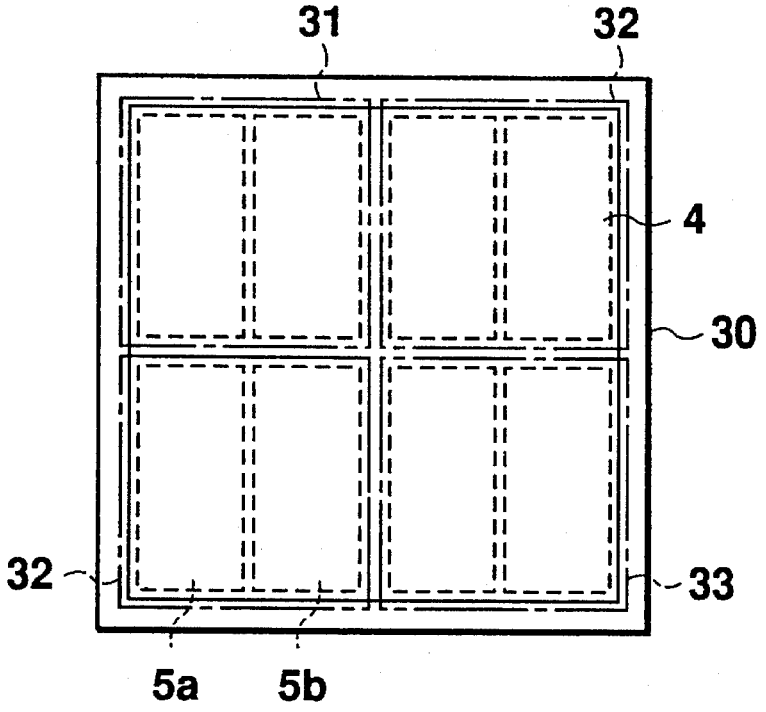

In FIGS. 24*a* and 24*b*, there is shown the eleventh embodiment of a box type fluorescent lamp 30 to be used as one pixel for a color image display device according to the present invention. In this embodiment, the fluorescent lamp 30 includes three primary color illumination parts 31, 32 and 88 of red R, green G and blue B. A plurality of fluorescent lamps 30 as the pixels are arranged in a matrix form on a flat surface to constitute a color image display device.

In the fluorescent lamp shown in FIGS. 14*a* and 14*b* or FIGS. 16*a* and 16*b*, the discharge is generated between each electrode pair, but the generated light is projected to the outside. When these fluorescent lamps are used for the display device, the outline of the pixel becomes dim. Further, the discharge can be generated between the adjacent electrode pairs. In order to improve these problems, other embodiments of the fluorescent lamps are developed as shown in FIGS. 25*a* and 25*b* and FIGS. 26*a* and 26*b*.

Figure 25A:
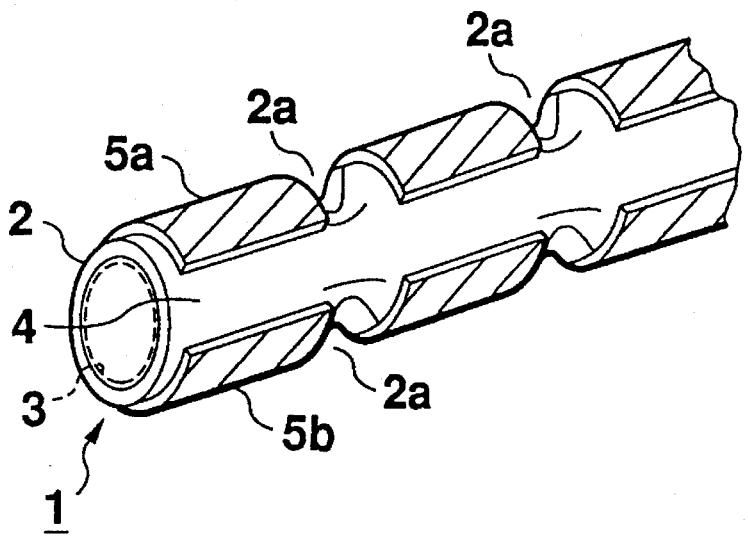
FIGS. 25*a* and 25*b* and FIGS. 26*a* and 26*b* are schematic perspective and cross sectional views of twelfth and thirteenth embodiments of a discharge lamp having a cylindrical glass bulb with hollowed sections parts on the surface between external electrode pairs according to the present invention.
Figure 25B:
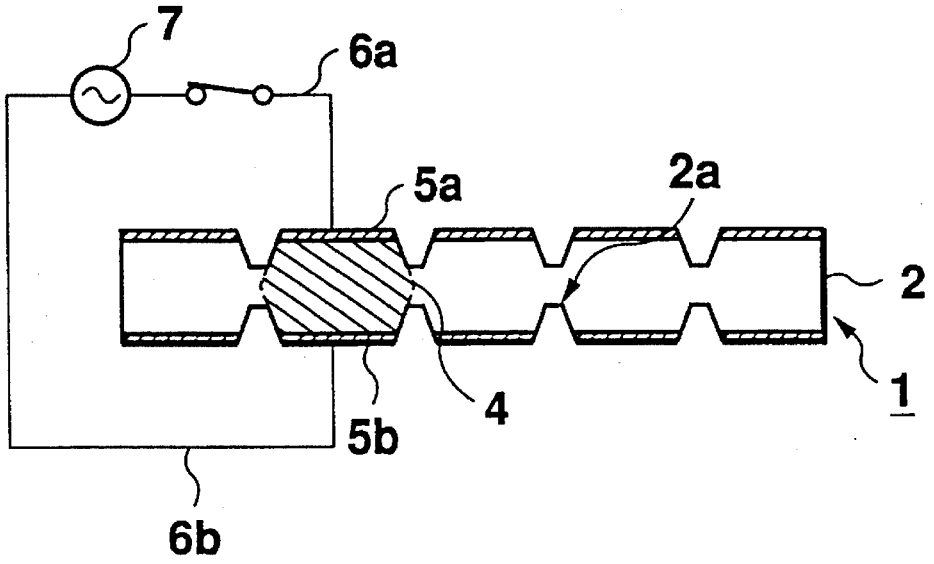

In FIGS. 25*a* and 25*b*, there is shown the twelfth embodiment of a fluorescent lamp 1 according to the present invention. In this embodiment, hollow portions 2*a* are formed on the peripheral surface of the cylindrical glass bulb 2 between the electrodes constituting the electrode pairs of the fluorescent lamp shown in FIG. 14*b*. In this case, by providing the hollow portions 2*a* on the glass bulb 2 between the electrode pairs, the mixing of the light generated at the adjacent electrode pairs can be largely reduced. By using this fluorescent lamp in the display device, an image display device having a simple construction can be produced, and a clear outline display can be performed.

Figure 26A:
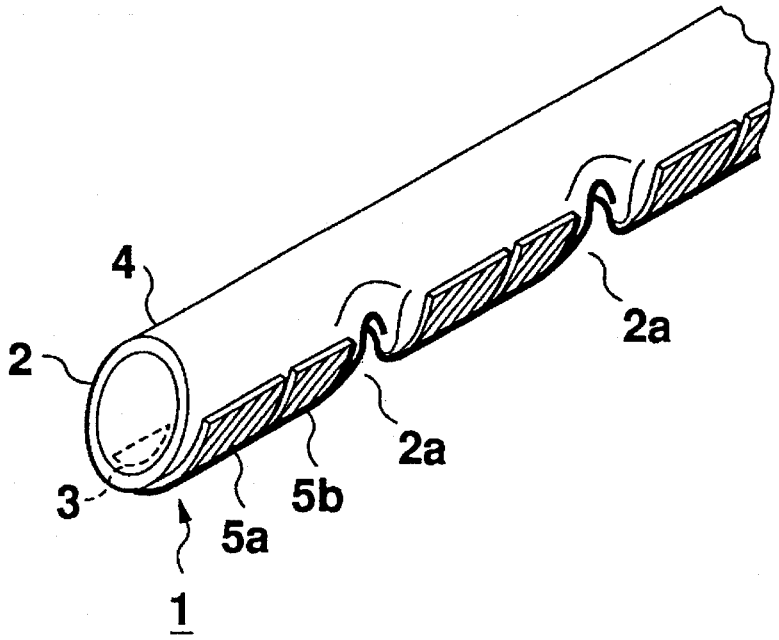
Figure 26B:
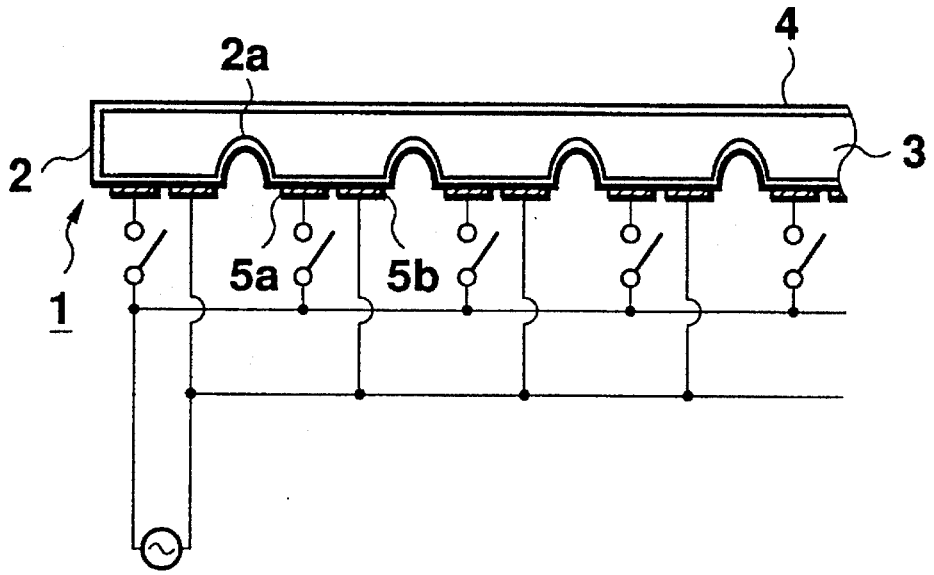

In FIGS. 26*a* and 26*b*, there is show the thirteenth embodiment of a fluorescent lamp 1 according to the present invention. In this embodiment, hollow portions 2*a* are formed on the peripheral surface of the cylindrical glass bulb 2 between the electrodes constituting the electrode pairs of the fluorescent lamp shown in FIG. 16*a*. The same effects as those of the twelfth embodiment shown in FIGS. 25*a* and 25*b* can be obtained.

Figure 27:
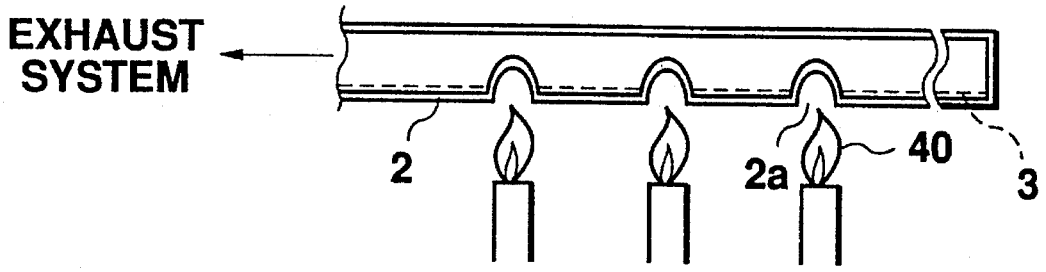
FIG. 27 is an elevational view showing a method for producing a discharge lamp having a cylindrical glass bulb with hollowed sections on the surface between external electrode pairs according to the present invention.

In FIG. 27, there is shown one method for producing a discharge lamp having the hollow portions 2*a* on the peripheral surface of the cylindrical glass bulb 2 between the external electrode pairs according to the present invention. In this embodiment, before one open end of the glass bulb 2 is closed, the glass bulb 2 is heated at the positions where the hollow portions 2*a* by are to be formed a heating device 40. During the heating of the glass bulb 2, the gas enclosed in the glass bulb 2 is sucked from the open end of the glass bulb 2, by using an exhaust system (not shown) such as a vacuum pump, to reduce the pressure in the glass bulb 2. Then, the portions which have become softened by the heating become depressed by virtue of the reduced pressure in the glass bulb 2 to thus form the hollow portions 2*a* on the glass bulb 2 of the fluorescent lamp shown in FIGS. 25*a* and 25*b* or FIGS. 26*a* and 26*b*.

Figure 28:
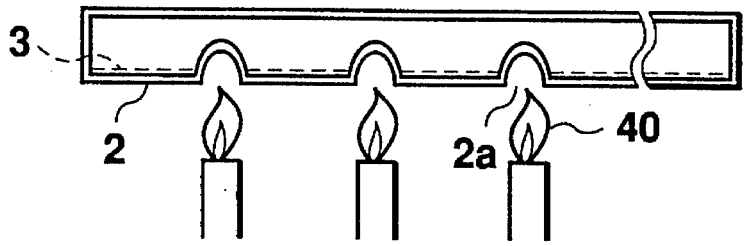
FIG. 28 is an elevational view showing another method for producing a discharge lamp having a cylindrical glass bulb with hollowed sections on the surface between external electrode pairs according to the present invention.

In FIG. 28, there is shown another method for producing a discharge lamp having the hollow parts 2*a* on the peripheral surface of the cylindrical glass bulb 2 between the external electrode pairs according to the present invention. In this embodiment, the inside of the glass bulb 2 is sucked to reduce the pressure inside thereof in advance, and, after the discharge medium such as the rare gas is enclosed in the reduced glass bulb 2 so that the pressure in the glass bulb 2 is still lower than the atmospheric pressure, the glass bulb 2 is heated at positions where the hollow portions 2*a* are to be formed by the heating device 40. During the heating of the glass bulb 2, the portions which have become softened by the heating become hollow due to the difference between the inside pressure of the glass bulb 2 and the atmospheric pressure to thus form the hollow portions 2*a* on the glass bulb 2 of the fluorescent lamp shown in FIGS. 25*a* and 25*b* or FIGS. 26*a* and 26*b*.

In the above-described embodiments according to the present invention, although the surface electrodes are formed by the sheet form electrodes, net form electrodes or electrodes formed by arranging a plurality of linear materials in parallel can also be used. Further, although a plurality of electrodes are arranged in the axial direction or perpendicular direction of the cylindrical container or the like, the electrodes can be arranged in an inclined direction of the container. Also, although the electrodes are mounted on the external surface of the glass bulb 2 and the discharge is generated between the electrodes via the glass of the dielectric substance, the electrodes can be embedded in the dielectric substance.

Figure 29:
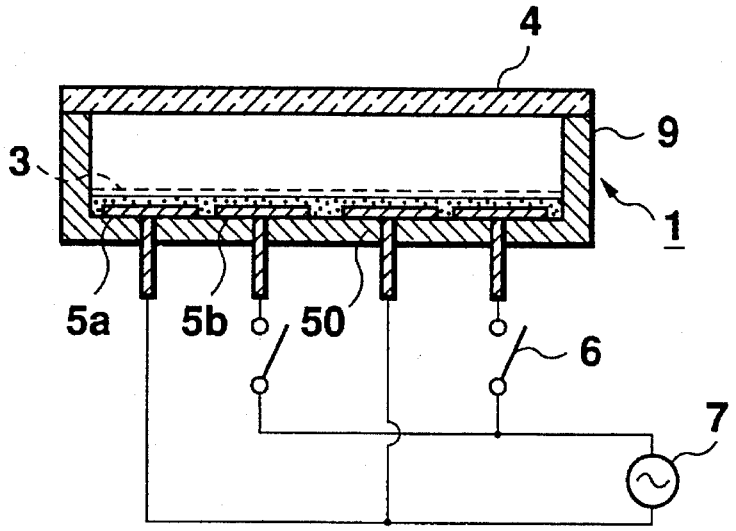
FIG. 29 is a cross sectional view of a fourteenth embodiment of a discharge lamp having electrodes formed on the internal surface of a container, the inside of the electrodes being covered by a dielectric layer, according to the present invention.
Figure 30A:
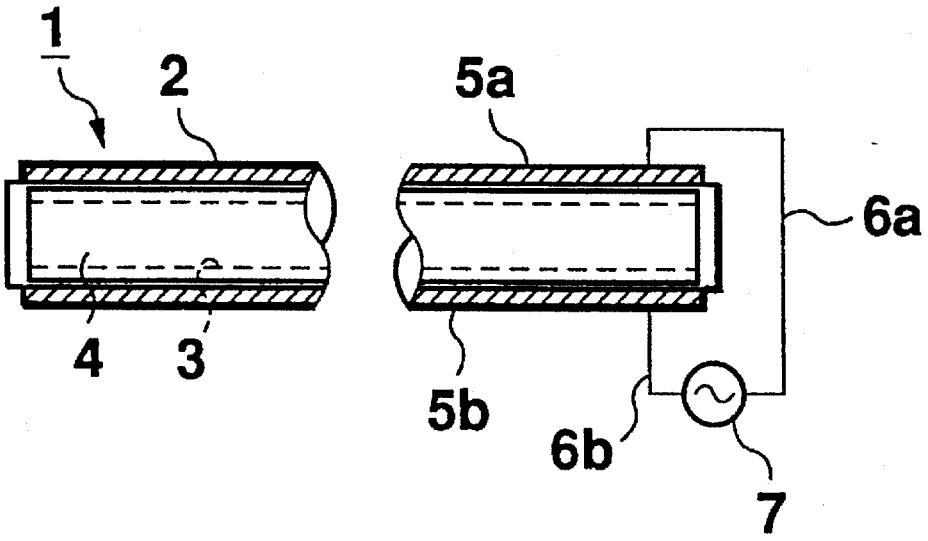
Fig. 30a PRIOR ART
FIGS. 30*a* and 30*b* are a partially cut away and a cross sectional view respectively, of a conventional fluorescent lamp.
Figure 30B:
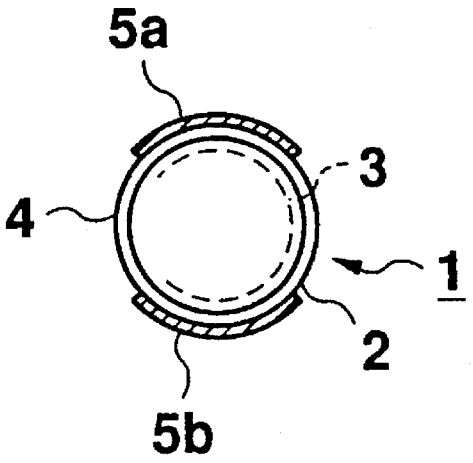
Fig. 30b PRIOR ART

In FIG. 29, there is shown the fourteenth embodiment of a fluorescent lamp having electrodes formed on the internal surface of a box type container, the inside of the electrodes being covered by a dielectric layer, according to the present invention. In this embodiment, the electrodes 5*a* and 5*b* are formed on the internal surface of a container body 9, and then the dielectric substance is formed on the internal surface side of the electrodes so as to cover the same by a vapor deposition or the like to form a dielectric substance layer 50. A fluorescent substance layer 3 is formed on the dielectric substance layer 50 opposite to a light output part 4. The light output part 4 is formed of a glass material, but the material of the container body 9 is not restricted to glass material. In this embodiment, the container body 9 is formed of a ceramic material. In this instance, the dielectric substance layer 50 is not subjected to a stress caused by the pressure difference between the inside and the outside of the fluorescent lamp, and thus it can be made thinner compared with the above-described embodiments. As a result, the field intensity of the discharge space can be enlarged, and the impedance of the dielectric substance layer 50 can be reduced. Hence, the discharge of the fluorescent lamp can be carried out at a low voltage.

In the aforementioned embodiments according to the present invention, although xenon is used as the rare gas enclosed within the lamp, another rare gas such as krypton, argon, neon or helium, a mixture of at least two rare gases or another medium for discharging can be used.

Further, although the present invention is applied to the fluorescent lamp, the UV rays generated by the discharge are not necessarily converted into visible light and can be utilized as a UV lamp.

As described above, according to the present invention, the following effects can be obtained.

(1) Since the area of the surface electrodes can be widened compared with the conventional lamp, a large light output can be obtained.

(2) Since the edges of the surface electrodes are made close to one another, the discharge becomes stable.

(3) Since the discharge is generated at only the electrode parts to which the voltage is applied, a plurality of electrode pairs are mounted on one fluorescent lamp, and by selectively applying the voltage to the electrode pairs, a plurality of parts divided in one fluorescent lamp can be selectively illuminated. Hence, when this fluorescent lamp is used for illumination, the number of the electrode pairs that the voltage is applied to is varied to change the luminance, illumination positions and the like. Further, a plurality of fluorescent lamps of the present invention are arranged to constitute an image display-device. Further, by providing the fluorescent lamps of three primary colors such as red, green and blue, a color image display device can be produced.

(4) In the case of the fluorescent lamp in which a plurality of divided parts are selectively illuminated, by providing hollow portions between the electrode pairs, the discharge between the adjacent two electrode pairs can be prevented, and the leakage of light from the electrode pair illuminating to the outside can also be prevented.

(5) By using the method for producing the fluorescent lamp having hollow portions, the fluorescent lamp can be easily produced.

Although the present invention has been described in its preferred embodiments with reference to the accompanying drawings, it readily understood that the present invention is not restricted to the preferred embodiments and that various changes and modifications can be made by those skilled in the art without departing from the spirit and scope of the present invention.

What is claimed is:

1. An image display device, comprising:

a plurality of discharge lamps arranged in parallel, each of said discharge lamps comprising;

a container enclosing a discharge medium;

a coating, disposed on at least part of an inner surface of the container, that generates a substantially uniform visible light when excited by a substantially uniform light; and electrode means for generating the substantially uniform light within the medium, the light impinging on the coating to generate the substantially uniform visible light, the electrode means including a surface electrode pair having electrodes disposed over a majority of the inner surface area of the container having the coating.

2. The image display device of claim 1, wherein the container of said discharge lamp is cylindrical, and the electrodes of the surface electrode pair are arranged to be coaxially adjacent to each other in a longitudinal direction of said cylindrical container.

3. The image display device of claim 2, wherein said plurality of discharge lamps include discharge lamps which generate red, green and blue color light.

4. The image display device of claim 3, wherein a predetermined set of red, green and blue color discharge lamps constitute a unit, and a plurality of said units are arranged in a matrix form.

5. The image display device of claim 3, further comprising a holder for holding said discharge lamps from a first side, said holder arranged in a direction perpendicular to the longitudinal direction of said cylindrical discharge lamps, and said holder covering the space between said electrode pairs of said discharge lamps.

6. The image display device of claim 3, further comprising a holder for holding said discharge lamps from a second side, said holder being formed along the second side of said discharge lamps.

7. The image display device of claim 3, further comprising a holder of a transparent resin material for embedding and holding said discharge lamps.

8. The image display device of claim 3, wherein a rare gas is enclosed in the container of said discharge lamps, and an excimer of the rare gas is generated by the discharge between said electrodes.

9. The image display device of claim 8, wherein said rare gas in xenon.

10. The image display device of claim 2 wherein the container has a light output part for outputting light from the longitudinal direction of the cylindrical container, and wherein the electrode means surrounds the peripheral surface of the cylindrical container except for gaps separating the electrodes of the surface electrode pair, the gap being of a size to prevent dielectric breakdown.

11. The image display device of claim 1, wherein a cross section of said container is substantially ellipsoidal, and the surface electrode pair is mounted on a peripheral surface of said container on opposite sides of said ellipse.

12. The image display device of claim 1, wherein the container is of cylindrical shape except for hollow portions formed on a peripheral surface of the container, the hollow portions directed towards the longitudinal axis of the container, and wherein the electrodes of the surface electrode pair are arranged to be coaxially adjacent to each other in the longitudinal direction of said cylindrical container, the electrodes of the surface electrode pair being separated by the hollow portions.

13. The image display device of claim 1, wherein a cross section of said container is substantially triangular.

14. The image display device of claim 1, wherein the electrode means for generating the substantially uniform light includes means for supplying an excitation voltage to the electrodes, the excitation voltage causing a current density greater than a first threshold level to flow through the electrodes to cause the visible light to be substantially uniformly created at the inner surface of the container adjacent the electrodes and the current density being less than a second threshold level to prevent formation of discharge channels within the container.

15. The image display device of claim 1 wherein the container is filled with a gas at a pressure of greater than 100 Torr.

16. The image display device of claim 1 wherein a density of current induced between the surface electrode pair and the opposing inside surface of the container is no more than 5 $mA/cm^2$.

17. The image display device of claim 1 wherein the electrodes of the surface electrode pair are arranged to be coaxially adjacent to each other in a longitudinal direction of the container, the surface electrode pair being electrically separated from an adjacent pair by hollow portions of the container, directed in the longitudinal direction and wherein each electrode is separated from an adjacent electrode of the pair by a gap no more than 3 mm in length.

18. The image display device of claims 15, 16 or 17 wherein the plurality of discharge lamps include discharge lamps which generate red, green and blue color light.

19. The image display device of claims 15, 16 or 17 wherein the container of said discharge lamp is cylindrical, and the surface electrode pair is mounted on a peripheral surface of said cylindrical container on opposite sides of said discharge space.

20. The image display device of claims 15, 16 or 17 wherein the surface electrode pair includes a first and second electrode, the first and second electrode being separated by an insulating member disposed on the container.

21. The image display device of claims 15, 16 or 17 wherein the electrode means includes at least one additional surface electrode pair, each surface electrode arranged such that a first and second electrode of the electrode pair receive the predetermined voltage and are separated by a corresponding insulating member.

22. The image display device of claims 15, 16 or 17 wherein the electrode means further includes an additional electrode, and wherein each electrode receives the predetermined voltage and each electrode separated from an adjacent electrode by an insulating member.

23. The image display device of claim 18, wherein a predetermined set of red, green and blue color discharge lamps constitute a unit, and a plurality of units are arranged in a matrix form.

24. The image display device of claim 18, further comprising a holder for holding said discharge lamps from a first side, the holder arranged in a direction perpendicular to a longitudinal direction of said discharge lamps, said holder covering the space between said electrode pairs of said discharge lamps.

25. The image display device of claim 18, further comprising a holder for holding said discharge lamp from a second side, said holder being formed along the second side of said discharge lamps.

26. The image display device of claim 18, further comprising a holder of a transparent resin material for embedding and holding said discharge lamps.

27. The image display device of claim 18, wherein a rare gas is enclosed in the container of said discharge lamps, and an excimer of the rare gas is generated by the discharge between said electrodes.

28. The image display device of claim 27, wherein said rare gas is xenon.

29. The image display device of claim 19 wherein the container has a light output part for outputting light along a longitudinal direction of the cylindrical container, and wherein the electrode means surrounds the peripheral surface of the cylindrical container except for gaps separating electrodes of the surface electrode pair, the gap being of a size to prevent dielectric breakdown.

30. An image display device, comprising:

a plurality of discharge lamps arranged in parallel, each of said discharge lamps comprising a container for enclosing a medium for discharge therein, said container having a substantially square cross section;

electrode means for exciting a discharge space within said container, said electrode means having at least one surface electrode pair for receiving a predetermined voltage to be applied said container to excite the discharge space within the container, said electrode means being mounted on one side surface of the square cross-section only; and means for controlling the predetermined voltage.

31. The image display device of claim 30, wherein each discharge lamp generates red, green and blue color light.

32. An image display device, comprising:

a plurality of discharge lamps arranged in parallel, each of said discharge lamps comprising a container for enclosing a medium for discharge therein, wherein a cross section of said container is substantially triangular;

electrode means for exciting a discharge space within said container, said electrode means having at least one surface electrode pair for receiving a predetermined voltage to be applied to said container to excite the discharge space within the container, said electrode means surrounding a majority of the surface area of said container, the surface electrode pair being arranged to be adjacent to each other in a longitudinal direction of said container; and means for controlling the predetermined voltage.

33. An image display device, comprising:

a plurality of discharge lamps arranged in parallel, each of said discharge lamps comprising a container for enclosing a medium for discharge therein, wherein a cross section of said container is substantially elliptical;

electrode means for exciting a discharge space within said container, said electrode means having at least one surface electrode pair for receiving a predetermined voltage to be applied to said container to excite the discharge space within the container, said electrode means surrounding a majority of the surface area of said container, electrodes of the surface electrode pair being disposed around the substantially elliptical container, the surface electrode pair being arranged to be adjacent to each other in a longitudinal direction of said container; and means for controlling the predetermined voltage.

* * * * *